US010431239B2

(12) United States Patent
Jensen et al.

(10) Patent No.: US 10,431,239 B2
(45) **Date of Patent: *Oct. 1, 2019**

(54) HEARING SYSTEM

(71) Applicant: Oticon A/S, Smørum (DK)

(72) Inventors: Jesper Jensen, Smørum (DK); Michael Syskind Pedersen, Smørum (DK); Mojtaba Farmani, Smørum (DK); Pauli Minnaar, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/212,405

(22) Filed: Dec. 6, 2018

(65) Prior Publication Data

US 2019/0115041 A1 Apr. 18, 2019

Related U.S. Application Data

(63) Continuation of application No. 14/887,989, filed on Oct. 20, 2015, now Pat. No. 10,181,328.

(30) Foreign Application Priority Data

Oct. 21, 2014 (EP) ..... 14189708

(51) Int. Cl.

| | |
|---|---|
| ***H04R 25/00*** | (2006.01) |
| ***G10L 21/0232*** | (2013.01) |
| ***H04R 5/033*** | (2006.01) |
| *H04R 1/10* | (2006.01) |
| *H04S 7/00* | (2006.01) |

(52) U.S. Cl.

CPC ..... *G10L 21/0232* (2013.01); *H04R 5/033* (2013.01); *H04R 25/407* (2013.01); *H04R 25/552* (2013.01); *H04R 25/554* (2013.01); *H04R 1/1083* (2013.01); *H04R 25/43* (2013.01); *H04R 25/558* (2013.01); *H04R 2225/43* (2013.01); *H04R 2410/05* (2013.01);

(Continued)

(58) Field of Classification Search

CPC .. H04R 25/407; H04R 25/552; H04R 25/554; H04R 25/558; G10L 21/0232

See application file for complete search history.

(56) References Cited

U.S. PATENT DOCUMENTS

| | | | |
|---|---|---|---|
| 4,259,547 | A | 3/1981 | Valley et al. |
| 8,265,284 | B2 | 9/2012 | Villemoes et al. |

(Continued)

FOREIGN PATENT DOCUMENTS

| | | | |
|---|---|---|---|
| EP | 2 563 045 | A1 | 2/2013 |
| EP | 2 584 794 | A1 | 4/2013 |
| WO | WO 2008/083712 | A1 | 7/2008 |

OTHER PUBLICATIONS

Boll, "Suppression of Acoustic Noise in Speech Using Spectral Subtraction", IEEE Transactions on Acoustics, Speech and Signal Processing, IEEE Inc. New York, USA, Apr. 1, 1979, vol. 27, No. 2, pp. 113-120.

(Continued)

*Primary Examiner* — Regina N Holder

(74) *Attorney, Agent, or Firm* — Birch, Stewart, Kolasch & Birch, LLP

(57) ABSTRACT

The present disclosure regards a hearing device configured to receive acoustical sound signals and to generate output sound signals comprising spatial cues.

13 Claims, 11 Drawing Sheets

(52) U.S. Cl.
CPC ..... *H04S 7/302* (2013.01); *H04S 2400/11* (2013.01); *H04S 2420/01* (2013.01)

(56) References Cited

U.S. PATENT DOCUMENTS

| | | | | |
|---|---|---|---|---|
| 2009/0243933 | A1* | 10/2009 | Shirakawa | G01S 3/74 342/417 |
| 2013/0101128 | A1 | 4/2013 | Lunner et al. | |
| 2015/0163602 | A1 | 6/2015 | Pedersen et al. | |

OTHER PUBLICATIONS

Cai et al., "Subband Spectral-Subtraction Speech Enhancement Based on the DFT Modulated Filter Banks", ICSP2012 Proceedings, 2012 IEEE 11th International Conference, Oct. 21, 2012, pp. 571-574.

Usman et al., "Real Time Humanoid Sound Source Localization and Tracking in a Highly Reverberant Environment", ICSP2008 Proceedings, 2008 IEEE 9th International Conference, Piscataway, NJ, USA, Oct. 26, 2008, pp. 2661-2664.

* cited by examiner

HEARING SYSTEM

This application is a Continuation of copending application Ser. No. 14/887,989, filed on Oct. 20, 2015, which claims priority under 35 U.S.C. § 119(a) to Application No. 14189708.2, filed in the European Patent Office on Oct. 21, 2014, all of which are hereby expressly incorporated by reference into the present application.

The disclosure regards a hearing device and a hearing system comprising the hearing device and a remote unit. The disclosure further regards a method for generating a noiseless binaural electrical output sound signal.

Hearing devices are used to improve or allow auditory perception, i.e., hearing. Hearing aids, as one group of hearing devices, are commonly used today and help hearing impaired people to improve their hearing ability. Hearing aids typically comprise a microphone, an output sound transducer, electric circuitry, and a power source, e.g., a battery. The output sound transducer can for example be a speaker, also called receiver, a vibrator, an electrode array configured to be implanted in a cochlear, or any other device that is able to generate a signal from electrical signals that the user perceives as sound. The microphone receives an acoustical sound signal from the environment and generates an electrical sound signal representing the acoustical sound signal. The electrical sound signal is processed, e.g., frequency selectively amplified, noise reduced, adjusted to a listening environment, and/or frequency transposed or the like, by the electric circuitry and a processed, possibly acoustical, output sound signal is generated by the output sound transducer to stimulate the hearing of the user or at least present a signal that the user perceives as sound. In order to improve the hearing experience of the user, a spectral filter bank can be included in the electric circuitry, which, e.g., analyses different frequency bands or processes electrical sound signals in different frequency bands individually and allows improving the signal-to-noise ratio. Spectral filter banks are typically running online in any hearing aid today.

Hearing aid devices can be worn on one ear, i.e. monaurally, or on both ears, i.e. binaurally. The binaural hearing aid system stimulates hearing at both ears. Binaural hearing systems comprise two hearing aids, one for a left ear and one for a right ear of the user. The hearing aids of the binaural hearing system can exchange information with each other wirelessly and allow spatial hearing.

One way to characterize hearing aid devices is by the way they are fitted to an ear of the user. Hearing aid styles include for example ITE (In-The-Ear), RITE (Receiver-In-The-Ear), ITC (In-The-Canal), CIC (Completely-In-the-Canal), and BTE (Behind-The-Ear) hearing aids. The components of the ITE hearing aids are mainly located in an ear, while ITC and CIC hearing aid components are located in an ear canal. BTE hearing aids typically comprise a Behind-The-Ear unit, which is generally mounted behind or on an ear of the user and which is connected to an air filled tube that has a distal end that can be fitted in an ear canal of the user. Sound generated by a speaker can be transmitted through the air filled tube to an ear drum of the user's ear canal. RITE hearing aids typically comprise a BTE unit arranged behind or on an ear of the user and a unit with a receiver, which is arranged in an ear canal of the user. The BTE unit and receiver are typically connected via a lead. An electrical sound signal can be transmitted to the receiver, i.e. speaker, arranged in the ear canal via the lead.

Today wireless microphones, partner microphones and/or clip microphones can be placed on target speakers in order to improve the signal-to-noise ratio of a sound signal to be presented to a hearing aid user. A sound signal generated from a speech signal of the target speaker received by the microphone placed on the target speaker is essentially noise free because the microphone is located close to the target speaker's mouth. The sound signal can be transmitted wirelessly to a hearing aid user, e.g., by wireless transmission using a telecoil, FM, Bluetooth, or the like. Then the sound signal is played back via the hearing aids speaker. The sound signal presented to the hearing aid user thus is largely free of reverberation and noise, and is therefore generally easier to understand and more pleasant to listen to than the same signal received by the microphones of the hearing aid(s), which is generally contaminated by noise and reverberation.

However, the signal is played back in mono, i.e., it does not contain any spatial cues relating to the position of the target speaker, which means that it sounds as if it is originating from inside the head of the hearing aid user.

U.S. Pat. No. 8,265,284 B2 presents an apparatus, e.g., a surround sound system and a method for generating a binaural audio signal from, e.g., audio data comprising a mono downmix signal and spatial parameters. The apparatus comprises a receiver, a parameter data converter, an M-channel converter, a stereo filter, and a coefficient determiner. The receiver is configured for receiving audio data comprising a downmix audio signal and spatial parameter data for upmixing the downmix audio signal. The components of the apparatus are configured to upmix the mono downmix signal using the spatial parameters and binaural perceptual transfer functions thus generating a binaural audio signal.

It is an object of the disclosure to provide an improved hearing device. It is a further object to provide an alternative to prior art.

These, and other, objects are achieved by a hearing device comprising a direction sensitive input sound transducer unit, a wireless sound receiver unit, and a processing unit. The hearing device is configured to be worn at, behind and/or in an ear of a user or at least partly within an ear canal. The direction sensitive input sound transducer unit is configured to receive acoustical sound signals and to generate electrical sound signals representing environment sound from the received acoustical sound signals. The wireless sound receiver unit is configured to receive wireless sound signals and to generate noiseless electrical sound signals from the received wireless sound signals. In the present context the term noiseless electrical sound signals is meant to be understood as signals representing sound having a high signal to noise ratio compared to the signal from the direction sensitive input transducer unit. In one example, a microphone positioned close to a sound source, e.g. in a body-worn device, is considered noiseless compared to a microphone positioned at a greater distance, e.g. in a hearing device on a second person. The signal of the body-worn microphone may also be enhanced by single- or multi-channel noise reduction, i.e. body-worn microphone may comprise a directional microphone or a microphone array. The processing unit is configured to process electrical sound signals and noiseless electrical sound signals in order to generate binaural electrical output sound signals. A user of the hearing device will most likely use a binaural hearing system, comprises two, usually, identical hearing device. When an external microphone transmits a signal to the binaural hearing system it will sound as if the sound is emanating from within the users head. Using the external microphone is advantageous as it may be placed on or near a person that the user of the hearing device wish to listen to, thereby providing a sound signal from that person which has a high signal-to-noise ratio, i.e. could be perceived as noiseless. By processing the sound from the external microphone, the sound may sound as if it originates from the correct spatial point.

An output signal from the hearing device could for example be an acoustical output sound signal, an electrical output signal or a sound vibration all depending of the output sound transducer type, which can for example be a speaker, a vibration element, a cochlear implant, or any other kind of output sound transducer, which is configured to stimulate the hearing of the user.

The output signals generated may contain both correct spatial cues and be nearly noiseless. If a user wears two hearing devices and binaural electrical output sound signals are generated in each of the two hearing devices as described above, the output signals allow spatial hearing with significantly reduced noise, i.e., the electrical output sound signals allow to generate a synthetic binaural sound using at least one output transducer at each ear of the user to generate stimuli from the electrical output sound signals which are perceivable as sound by the user.

Noiseless sound in this context is meant as sound that comprises a high signal-to-noise ratio, such that the sound is nearly or virtually noiseless, or at least that the noise and reverberation from the room has been reduced significantly. The wireless sound signal may be produced by an input sound transducer of a remote unit close to the mouth of a user, so that nearly no noise is received by the input sound transducer when the user of the remote unit speaks. The small distance of the input sound transducer of the remote unit to the mouth of the user also suppresses reverberation. The wireless sound signal can further be processed to increase the signal-to-noise ratio, e.g., by filtering, amplifying, and/or other signal operations to improve the signal quality of the wireless sound signal. The wireless sound signal can also be synthesized, e.g. be a computer generated voice, be pre-recorded or the like.

The hearing device can be arranged at, behind and/or in an ear. In an ear in this context also includes arrangement at least partly in the ear canal. The hearing device usually comprises one or two housings, a larger housing to be placed at the pinna of the wearer, and optionally a smaller housing to be placed at or in the opening of the ear canal or even so small that it may be placed deeper in the ear canal. Optionally, the housing of the hearing device may be a completely-in-the-canal (CIC), so that the hearing device is configured to be arranged completely in the ear canal. The hearing device can also be configured to be arranged partly outside the ear canal and partly inside the ear canal, or the hearing device can be of Behind-The-Ear style with a Behind-The-Ear unit that is configured to be arranged behind the ear and an inserting part which is configured to be arranged in the ear canal, sometimes referred to as a Receiver-In-The-Ear type. Further, one microphone may be arranged in the ear canal, and a second microphone may be arranged behind the ear, together forming a directional microphone.

The direction sensitive input sound transducer unit comprises at least one input sound transducer, which may be an array of input sound transducers, such as two, three, four or more than four input sound transducers. Use of more input sound transducers allows improving directionality of the directional input sound transducer and thus the accuracy of a determination location of a sound source and/or direction to an acoustical sound signal source received by the direction sensitive input sound transducer unit. Improved information regarding the direction to the sound source allows improving spatial hearing when the environment sound and noiseless sound information are combined in order to generate binaural electrical output sound signals. When using more than one input sound transducer, each input sound transducer receives the acoustical sound signals and generates electrical sound signals at the location of the respective direction sensitive input sound transducer. In a binaural hearing system, two input sound transducers may be placed one on each hearing device, e.g., one omnidirectional microphone on each hearing device, where the two electrical sound signals are used to establish a directional signal. The wireless sound receiver unit may be configured to receive one or more wireless sound signals. The wireless sound signals can be for example from more than one sound source, such that the hearing device can provide an improved hearing to the wearer for sound signals simultaneously received from one or more sound sources. The wireless sound receiver unit may be configured to receive electrical sound signals from another hearing device, e.g. a partner hearing device in a binaural hearing system.

Advantageously an improved, virtually noiseless, output sound signal comprising spatial cues may be generated. This output sound signal may be provided to a user via an output sound transducer in order to improve the hearing of a hearing impaired person.

The processing unit may be configured to use the noiseless electrical sound signal in order to identify noisy time-frequency regions in the electrical sound signals. The processing unit may be configured to attenuate noisy time-frequency regions of the electrical sound signals in order to generate electrical output sound signals. The processing unit may be configured to use the wireless sound signals in order to identify noisy time-frequency regions in the electrical noisy sound signals and the processing unit may configured to attenuate noisy time-frequency regions of the electrical noisy sound signals when generating the binaural electrical output sound signals, in this case a noise reduced hearing device microphone signal may be presented to the user. The processing unit may be configured to identify noisy time-frequency regions by subtracting the electrical sound signals from the noiseless electrical sound signal and determining whether time-frequency regions of the resulting electrical sound signals are above a predetermined value of a noise detection threshold. Thus, noisy time-frequency regions are time-frequency regions that are dominated by noise. It is alternatively possible to use any other method known to the person skilled in the art in order to determine noisy time-frequency regions in one or all of the electrical sound signals generated from the acoustical sound signals received by the direction sensitive input sound transducer unit.

The processing unit may be configured to use the direction sensitive input transducer in order to estimate a direction to the sound source relative to the hearing device. The processing unit can be configured to process the noiseless electrical sound signals using the estimated direction in order to generate binaural electrical output sound signals which may be perceived by the user of the hearing device as originating from that estimated direction. The direction can be understood as a relative direction indicated by an angle and phase. Thus the noiseless electrical sound signals can for example be filtered, e.g., convoluted, with a transfer functions in order to generate binaural electrical output sound signals that are nearly noiseless but comprises the correct spatial cues.

The hearing device may comprise a memory. The memory can be configured to store predetermined transfer function. Instead of, or in addition to, storing transfer function, sets of head related impulse responses, in the form of FIR filter coefficients, for different positions could be stored. The memory can also be configured to store other data, e.g., algorithms, electrical sound signals, filter parameters, or any other data relevant for the operation of the hearing device. The memory can be configured to provide transfer function, e.g., head related transfer functions (HRTFs), to the processing unit in order to allow the processing unit to generate binaural electrical output sound signals using the predetermined impulse responses. When a location of the target sound source relative to the user, i.e., sound source location, has been estimated, the noiseless electrical sound signals are preferably mapped into binaural electrical output sound signals with correct spatial cues. This may be done by convolving the noiseless electrical sound signals with predetermined impulse responses from the estimated sound source location. Due to this processing the electrical output sound signals are improved compared to the electrical sound signals generated by the input sound transducer unit in that they are nearly noiseless and improved compared to the wireless sound signals in that they have the correct spatial cues.

The memory may be configured to store predetermined transfer function for a predetermined number of directions relative to any input sound transducer of the direction sensitive input sound transducer unit. The directions are chosen such that a three dimensional grid is generated with the respective input sound transducer or a fixed point relative to the hearing device as the origin of the three dimensional grid and with predetermined impulse responses corresponding to locations in the three dimensional grid. In this case, the processing unit can be configured to estimate a sound source location relative to the user by comparing any processed electrical sound signals generated by convolving the noiseless electrical sound signals and the predetermined transfer function for each location in space relative to any input sound transducer of the direction sensitive input sound transducer unit to any electrical sound signals for each input sound transducer with the direction sensitive input sound transducer signal. If the input sound transducer unit for example has two input sound transducers, the processing unit compares the convolution of the noiseless electrical sound signals with the respective predetermined transfer functions for each location in space relative to the first and the second input sound transducer. Thus, there are two predetermined transfer functions for each location, one resulting for the first input sound transducer and one resulting for the second input sound transducer. Each of the two predetermined transfer functions is convolved with the noiseless electrical sound signals in order to generate two processed electrical sound signals, which ideally correspond to the electrical sound signals of generated by the first and second input sound transducer if the location corresponding to the predetermined transfer functions used for the convolution is the sound source location. Determining processed electrical sound signals for all locations and comparing the processed electrical sound signals to the electrical sound signals generated by the first and second input sound transducers allows determining the sound source direction, corresponding to the direction for which the processed electrical sound signals show the best agreement with the electrical sound signals generated by the first and second direction sensitive input sound transducers.

The memory may be configured to store predetermined transfer function for each direction sensitive input sound transducer relative to each other input sound transducer of the input sound transducer unit. Thus sound source locations can be estimated by using a transfer function from the sound source to one of the input sound transducers and using transfer functions from the one input sound transducer to the other input sound transducers.

Head-related transfer functions (HRTFs) can also be implemented without a database. A set of HRTFs can for example be broken down into a number of basis functions, by means of principle component analysis. These functions can be implemented as fixed filters and gains can be used to control the contribution of each component. See, e.g., Doris J. Kistler and Frederic L. Wightman, "A model of head-related transfer functions based on principal components analysis and minimum-phase reconstruction", J. Acoust. Soc. Am. 91, 1637 (1992).

Alternatively, the HRTFs may be stored approximately in parametric form, in order to reduce the memory requirements. As before, a binaural output signal may be generated by convolving the noiseless electrical sound signals with the parametric HRTFs.

Several methods could be envisioned for estimating the sound source location, i.e., the location of a target speaker. A hearing system may for example store in the memory predetermined impulse responses from a predetermined number of locations in space, e.g., in form of a three dimensional grid of locations to each input sound transducer in the hearing system. A hearing system can for example comprise two hearing devices with two input sound transducers each. In this case the hearing devices can comprise a transceiver unit in order to exchange data between the hearing devices, e.g., data such as electrical sound signals, predetermined impulse responses, parameters derived from processing the electrical sound signals, or other data for operating the hearing devices. The use of a total of four input sound transducers results in four predetermined impulse responses for each location, one impulse response to each input sound transducer. The aim is to determine from which of these locations an acoustical sound signal is most likely originating, i.e., the aim is to determine the sound source location. The hearing system therefore filters, e.g., convolves the noiseless electrical sound signal through each of the predetermined impulse responses. The resulting four processed electrical sound signals correspond to the acoustical sound signals that would be received, if the acoustical sound signals were originating from the specific direction corresponding to the predetermined transfer function. By comparing the four processed electrical sound signals synthesized in this way with the electrical sound signals generated from the actually received acoustical sound signals, and doing this for possible directions, the hearing device may identify the relative direction to the sound source which generates processed electrical sound signals corresponding the best to the actually received electrical sound signals.

When wanting to estimate the direction (angle and/or distance) to the sound source, e.g., a talker with an input sound transducer, e.g., a remote microphone, several methods can be applied. For the following methods a hearing system is used comprising two hearing devices, one at each ear of the user and a remote unit at another person, i.e., the talker. The remote unit comprises the input sound transducer, i.e., remote microphone and a remote unit transmitter, which transmits the remote auxiliary microphone (aux) signals generated by the remote microphone to each of the hearing devices worn by the user. A first method to estimate the direction to the sound source is based on the cross correlation between the electrical sound signals, e.g., microphone signals generated by each input sound transducer of each of the hearing devices worn by the user and the noiseless electrical sound signals, e.g., remote auxiliary microphone (aux) signals transmitted to the hearing devices worn by the user. The time delay values estimated at the two ears can be compared to get the interaural time difference (ITD). A second method uses cross correlation between the left and right microphone signals. This method does not use the aux signals in the estimation. A third method uses the phase difference between left and right microphone signals and/or the local front and rear microphone signals, if two microphones are arranged at a single hearing device. A fourth method involves creating beamformers between left and right microphone signals and/or the local front and rear microphone signals. By employing these methods the relative angle to the talker with the remote microphone can be estimated.

The processing unit may be configured to base the estimation of the sound source location relative to the user on a statistical signal processing framework. The processing unit can also be configured to base the estimation on a method formulated in a statistical signal processing framework, for example, it is possible to identify the sound source location in a maximum-likelihood sense.

It is, however, expected that the performance of the estimation may degrade in reverberant situations, where strong reflections make the sound source location difficult to identify unambiguously. In this situation, the processing unit can be configured to estimate the direction to the sound source based on sound signal time-frequency regions representing speech onset. The time-frequency regions of speech onset are in particular easy to identify in the noiseless electrical sound signals that are virtually noiseless. Speech onsets have the desirable property, that they are less contaminated by reverberation.

The processing unit may be configured to determine a value for a level difference of the noiseless electrical sound signals between two consecutive points of time or time periods. The processing unit can be configured to estimate the direction to the sound source whenever the value of the level difference is above a predetermined threshold value of the level difference. Thus, the processing unit may be configured to estimate the direction to the sound source whenever the onset of a sound signal, e.g. speech, is received by the wireless sound receiver, as the reverberation of the acoustical sound signals are expected to be reduced for sound onset situations. The processing unit can further be configured to determine a level difference between the electrical sound signals and the noiseless electrical sound signals in order to determine a noise level. The level difference between the electrical sound signals and the noiseless electrical sound signals corresponds to the noise level. Thus, the level of the electrical sound signals generated from the acoustical sound signals is compared to the level of the virtually noiseless noiseless electrical sound signal in order to estimate a noise and/or reverberation effect. The processing unit can further be configured to determine a value for a level difference of the noiseless electrical sound signal at two points of time only if the noise level is above a predetermined noise threshold value. Thus the level difference for the noiseless electrical sound signal between two points of time, i.e., sound onset, is only determined in a situation with noise and/or reverberation. If no noise or reverberation is present in the electrical sound signals the processing unit can be configured to estimate the sound source location continuously.

The hearing device may further comprise a user interface. The user interface is configured to receive input from the user. In the case that more than one location of a target sound source is determined the user may for instance be able to select which target sound source is attenuated or amplified by using the user interface. Thus in a situation in which more than one speaker is present in a room, e.g., during a cocktail party, the user may select, which speaker to listen to by selecting a direction or location relative to the hearing device or hearing aid system, via the user interface. This could be a graphical display indicating a number of angular sections seen in a down view of the user, so that the user may input which angular section to prioritise or limit to.

The present disclosure further presents a hearing system comprising at least one hearing device as described herein and at least one remote unit. The remote unit may then be configured to be worn at a user, i.e. on or at a body of a user different from the person using the hearing device. The remote unit may comprise an input sound transducer and a remote unit transmitter. The remote unit transmitter is preferably a wireless transmitter configured to transmit wireless signals to and/or from the remote unit to/from a hearing device. The remote unit transmitter may be configured to utilize protocols such as Bluetooth, Bluetooth low energy or other suitable protocol for transmitting sound information. The input sound transducer in the remote unit is configured to receive noiseless acoustical sound signals and to generate noiseless electrical sound signals. The transmitter is configured to generate wireless sound signals representing the noiseless electrical sound signals and further to transmit the wireless sound signals to the wireless sound receiver of the at least one hearing device.

The hearing system can be used for example by two users, in situations where more than one remote unit is present, a number of people may each be equipped with a remote unit. A first user, e.g., a hearing impaired person, wears a hearing device and a second user wears a remote unit. The hearing device user can then receive noiseless sound signals, which may then be processed to comprise the correct spatial cues to the first user. This allows an improved hearing for the first user, here a hearing-impaired person. If the two users are both hearing impaired, it is possible that each user wears a remote unit and a hearing device. In this case the remote units and hearing devices can be configured such that a first user receives the wireless sound signals of the remote unit of the second user at the first users hearing device and vice versa, such that the hearing is improved for both users of the hearing system.

In-the-head localization is the perception of a sound that seems as if it originates inside the head, in the present case this is due to the monophonic nature of the wireless sound signals being presented binaurally. In-the-head localization is also known as lateralization: The perceived sound seems to move on an axis inside the head. If the exact same signal is presented to both ears, it will be perceived as inside the head. The sound processed with correct directional cues supported by head movements as well as visibility of the talker all helps externalizing the sound so it is perceived as coming from the correct position, outside the head. This means that remote auxiliary microphone (aux) signals are detrimental for the spatial perception of sound because the sound source is perceived as originating from an unnatural position. When several wireless sound signals, i.e. aux signals, are transmitted from the remote units of several talkers to the hearing device at the same time an additional problem arises. Because all the signals are perceived in the same location (in the head) it can become very difficult to understand what the individual talkers are saying. Thus, the advantage of having several microphones is totally negated, because the user cannot make use of the spatial unmasking that occurs with natural (outside the head) signals. Therefore, spatializing the remote microphones can give a very pronounced improvement. Thus, the disclosure also relates to hearing systems or more generally to sound processing systems, which try to harvest the best aspects of the two signal types available at the hearing device:

The electrical sound signals generated from the acoustical sound signals at the hearing device(s) comprise spatially correct cues or at least close to spatially correct cues of the target sound source, i.e., target speaker or talker. The electrical sound signals, however, may be very reverberant and/or noisy.

The noiseless electrical sound signals generated from the wireless sound signals transmitted from the transmitter of the remote unit and received at the hearing device(s). The noiseless electrical sound signals are almost noise-free but lack spatial cues.

The disclosure also comprises an algorithm and/or method, which combines these two types of signals, to form binaural signals, i.e., electrical output sound signals to be presented at each ear of a user, which are essentially noise-free, but sound as if originating from the correct physical location. The electrical output sound signals generated by the method comprise the environment sound information and noiseless sound information, such that providing the electrical output sound signals to an output sound transducer allows generating output sound signals that are virtually noise-less and that comprise the correct spatial cues.

A method for generating electrical output sound signals may comprise a step of receiving acoustical sound signals. The method may further comprise a step of generating electrical sound signals comprising environment sound information from the received acoustical sound signals. Furthermore, the method may comprise a step of receiving wireless sound signals. The method may further comprise a step of generating noiseless electrical sound signals comprising noiseless sound information from the received wireless sound signals. Furthermore, the method may comprise a step of processing the electrical sound signals and noiseless electrical sound signals in order to generate electrical output sound signals, such that the electrical output sound signals comprise the environment sound information and the noiseless sound information.

An aspect of the disclosure provides a method to produce binaural sound signals to be played back to the hearing aid user, which are almost noise-free, or at least may be perceived as such, and which sound as if originating from the position of the target speaker.

The aforementioned method for generating electrical output sound signals may encompass a class of methods, which aim at enhancing the noisy and/or reverberant electrical sound signals generated from the received acoustical sound signals, e.g., by attenuating noise and reverberation based on the noiseless electrical sound signals generated from the noiseless or virtually noiseless received wireless sound signals.

Therefore, the method step of processing the electrical sound signals and electrical sound signals may comprise a step of using the noiseless sound information in order to identify noisy time-frequency regions in the electrical sound signals. The method can further comprise a step of attenuating noisy time-frequency regions of the electrical sound signal in order to generate electrical output sound signals.

The aforementioned method for generating electrical output sound signals on the other hand encompasses methods, which try to impose the correct spatial cues on the noiseless electrical sound signals generated from the wireless sound signals by using the environment sound information. This may for example be achieved through a two-stage approach: a) estimation of the sound source location, e.g., a target speaker, relative to a user performing the method by using the available signals, and b) using the estimated sound source location or a direction derived from the sound source location in order to generate binaural signals with correct spatial cues based on the noiseless electrical sound signals generated from the received wireless sound signals. The method may also take previous sound source location or direction estimates into account in order to prevent the perceived sound source location or direction to change if the estimated sound source location or direction of arrival of sound suddenly changes. The method thus may become more robust. In particular a built-in head-tracker based on accelerometers may be used to prevent sudden changes of the estimated sound source location due to movements of the head of the user.

Processing the electrical sound signals and noiseless electrical sound signals may comprise a step of using the environment sound information in order to estimate a directivity pattern. The method can further comprise a step of processing the noise-less electrical sound signals using the directivity pattern in order to generate electrical output sound signals.

The method may comprise a step of processing the electrical sound signals including a step of using the environment sound information in order to estimate a sound source location relative to a user. The method can further comprise a step of processing the noiseless electrical sound signals using the sound source location in order to generate electrical output sound signals comprising correct spatial cues.

A method for detecting sound source location relative to a hearing device at a particular moment in time may be useful in many situations. Knowing the relative direction and/or distance allows improved noise handling, e.g. by increased noise reduction. This could be in a direction sensitive microphone system, having adaptable directionality, where the directionality may be more efficiently adapted. Directionality of a microphone system is one form of noise handling for microphone systems. The method for detecting sound source location relative to a hearing device could be based on comparing a received signal to transfer functions representing a set of locations relative to the hearing device. Such a method could include the steps of: providing a input signal received at a microphone system of a hearing device, providing a plurality of transfer functions representing impulse responses from a plurality of locations relative to the hearing device when positioned at the head of a user, identifying among the plurality of transfer functions a best match with the received input signal to identify a most likely relative location of the sound source.

The method may be expanded by identifying a set of impulse responses giving best matches. The method may be implemented in e.g. the time domain and/or the frequency domain and/or the time-frequency domain and/or the modulation domain. The method may be used to identify a single source location, two source locations, or a number of source locations. The method may be used independently of a remote device, i.e. the method may be used with any type of hearing device. The method may advantageously be used in connection with a hearing device having a microphone system to be positioned at or in the ear of a user.

The aforementioned methods may further comprise methods and steps of methods that can be performed by or in a hearing device as described herein.

The disclosure further regards the use of the hearing system with at least one hearing device and at least one remote unit in order to perform the method for generating electrical output sound signals that are virtually noiseless and comprise the correct spatial cues.

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

Figure 3:
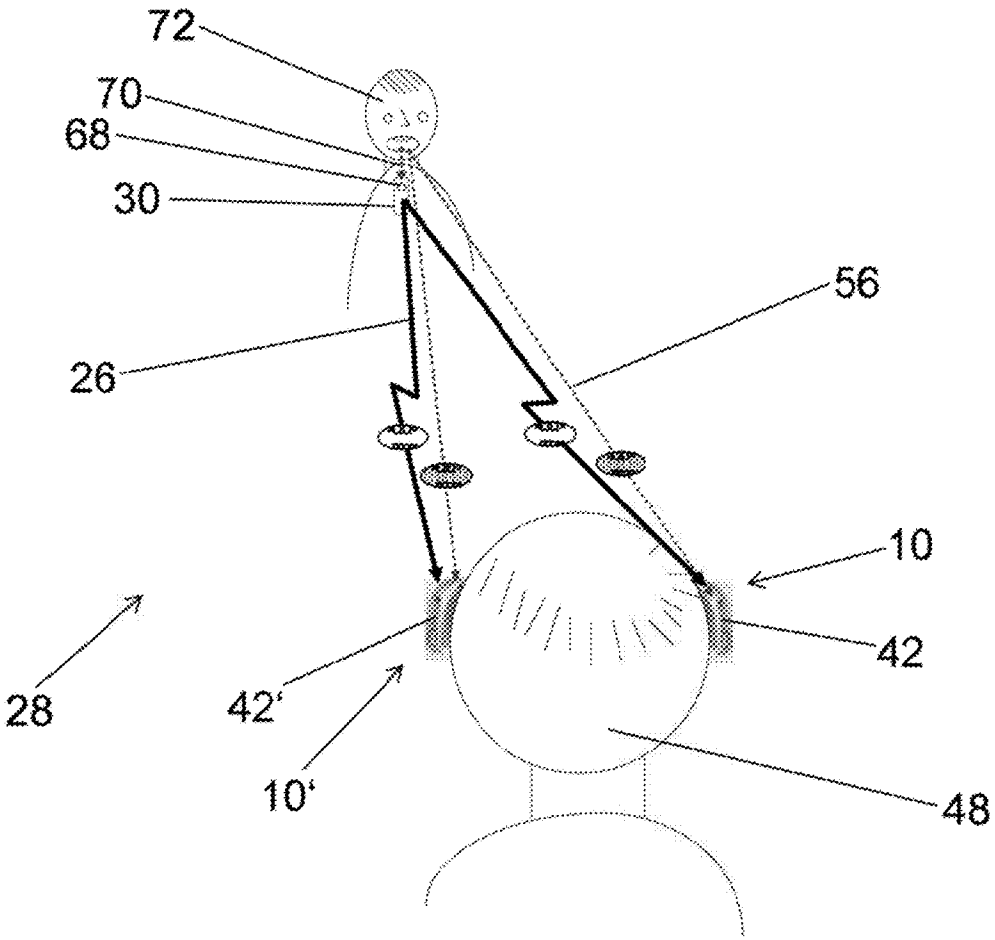
Figure 4:
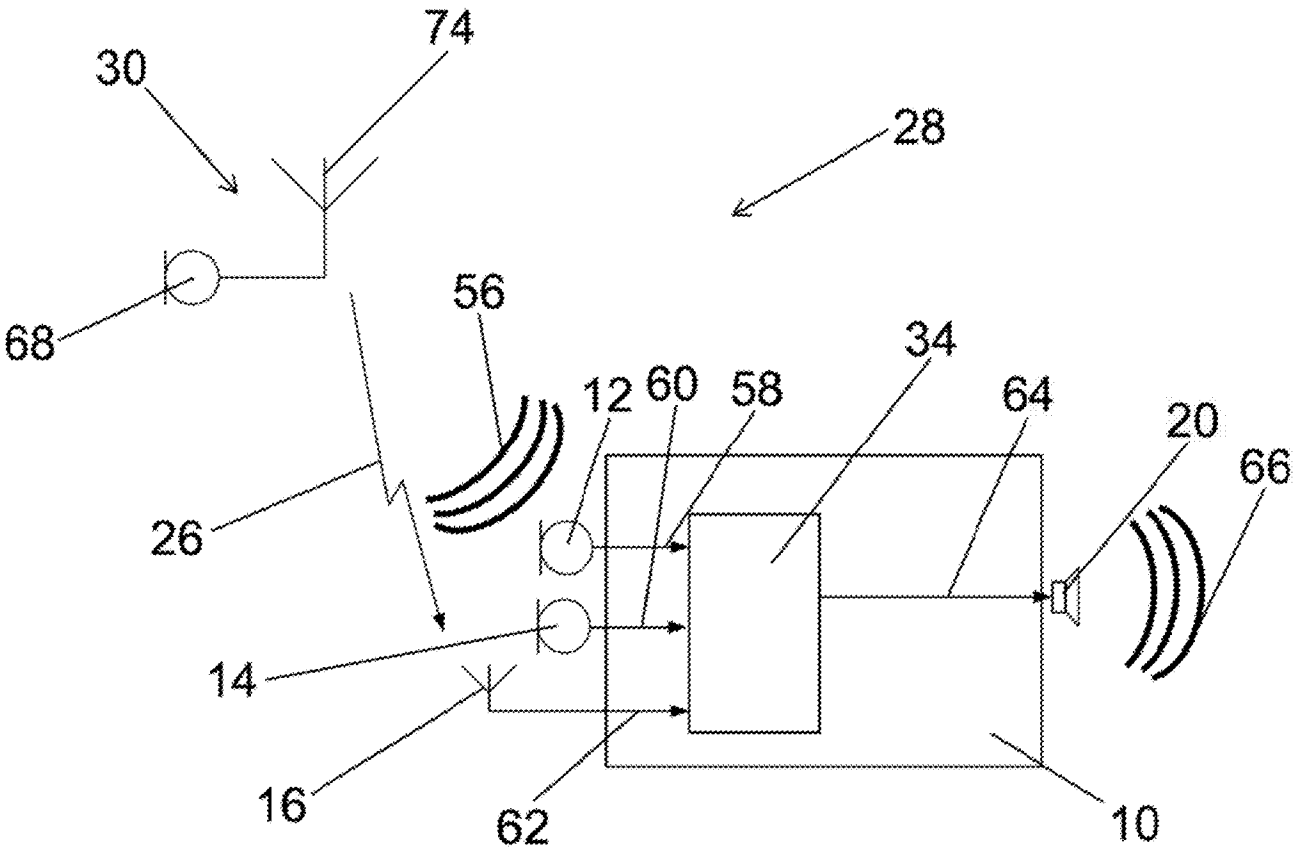
Figure 5:
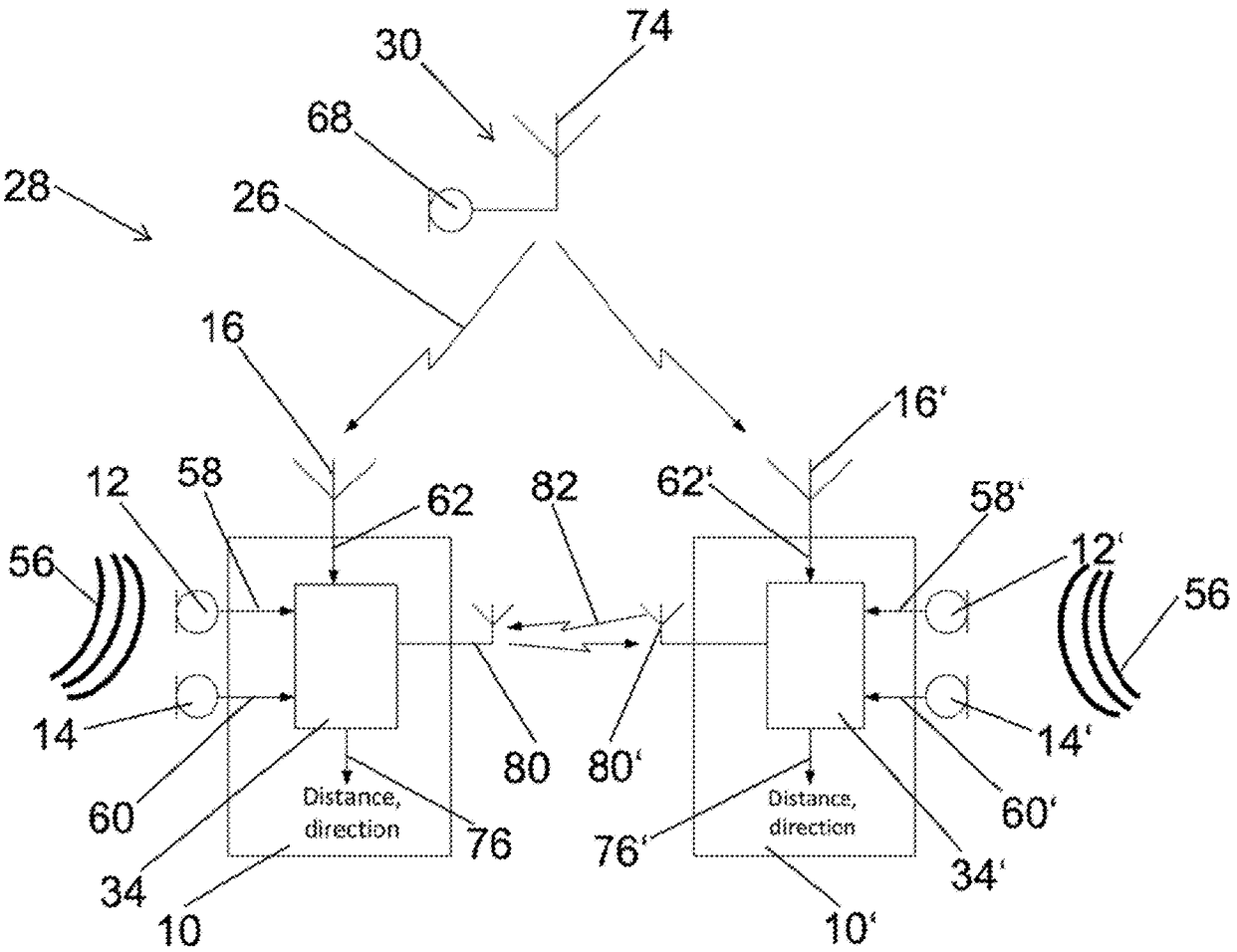
Figure 6:
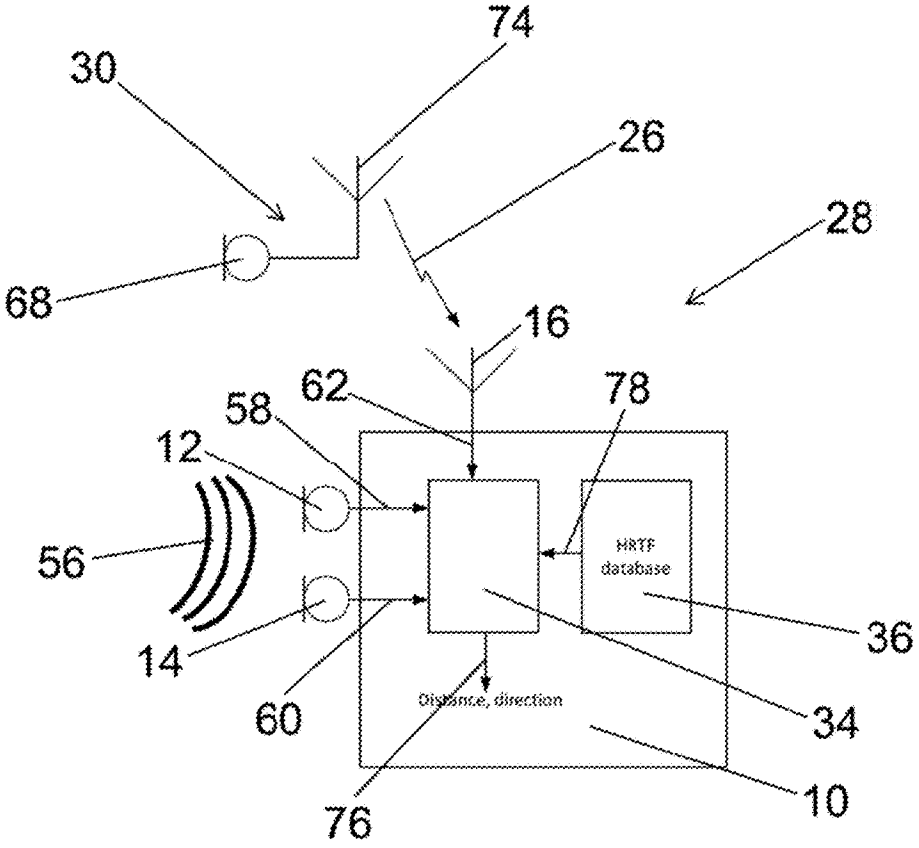
Figure 7:
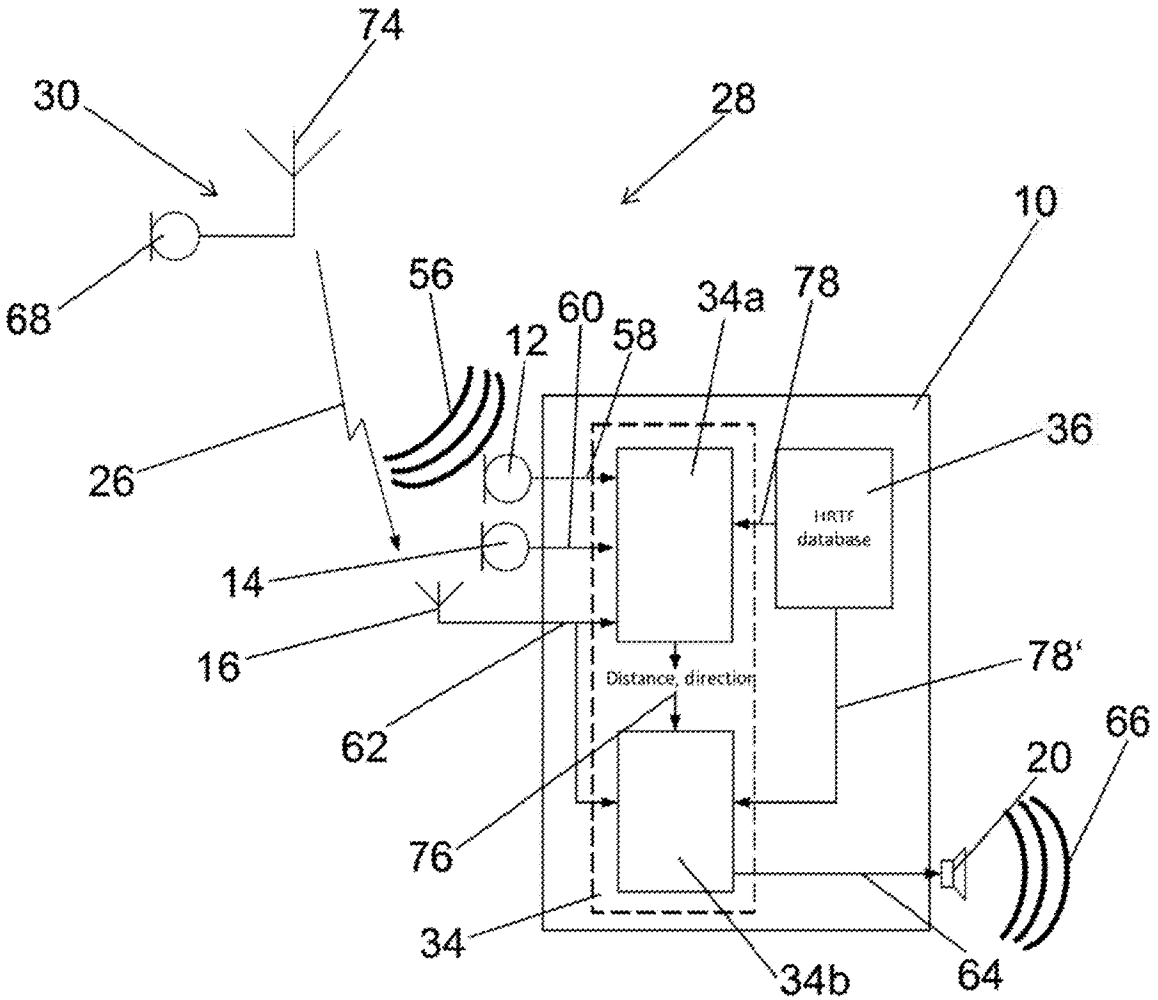
Figure 8:
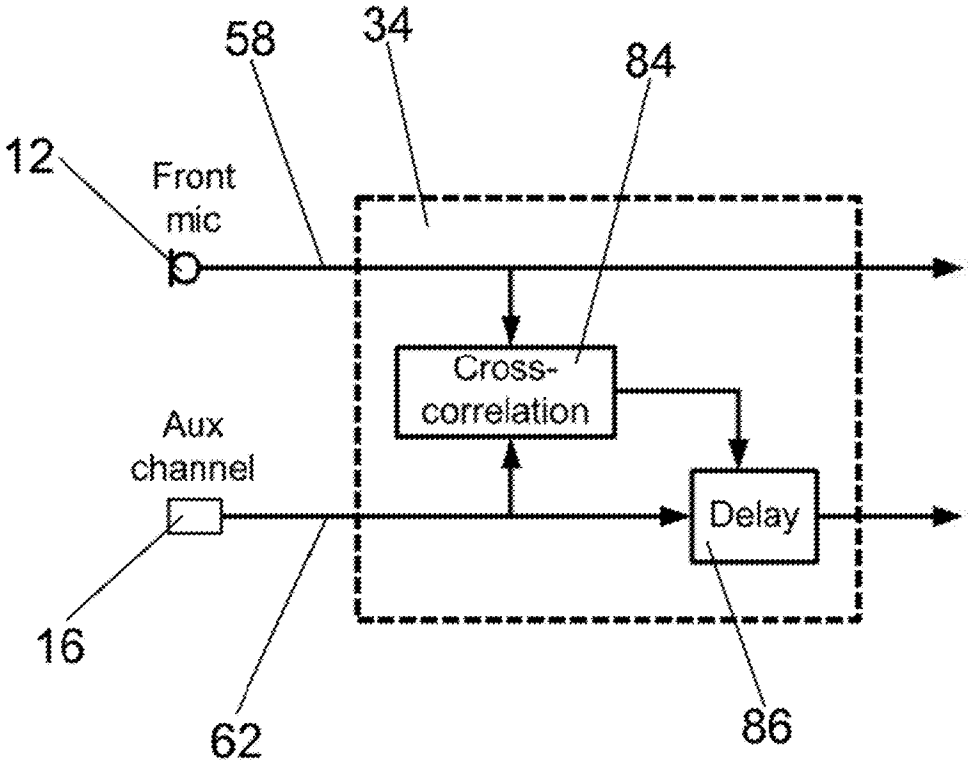
Figure 9:
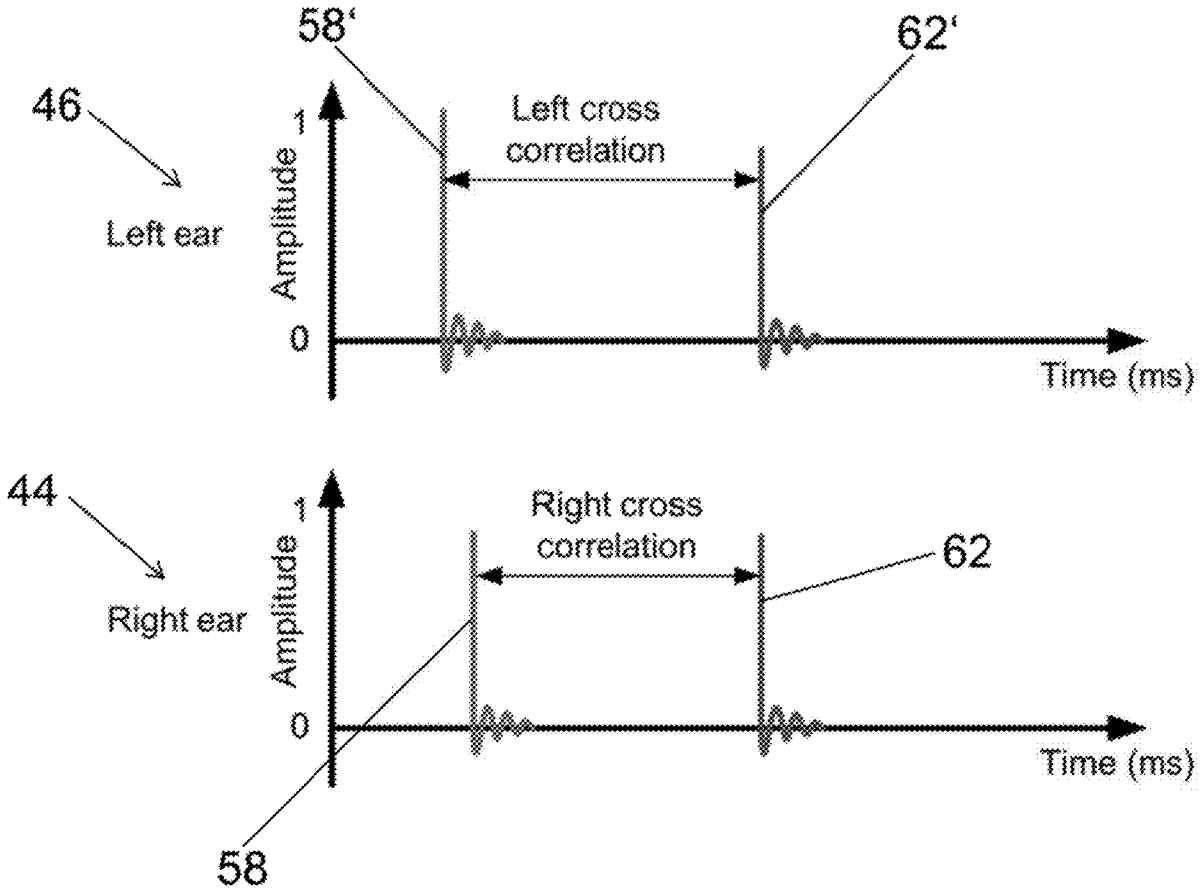
Figure 10:
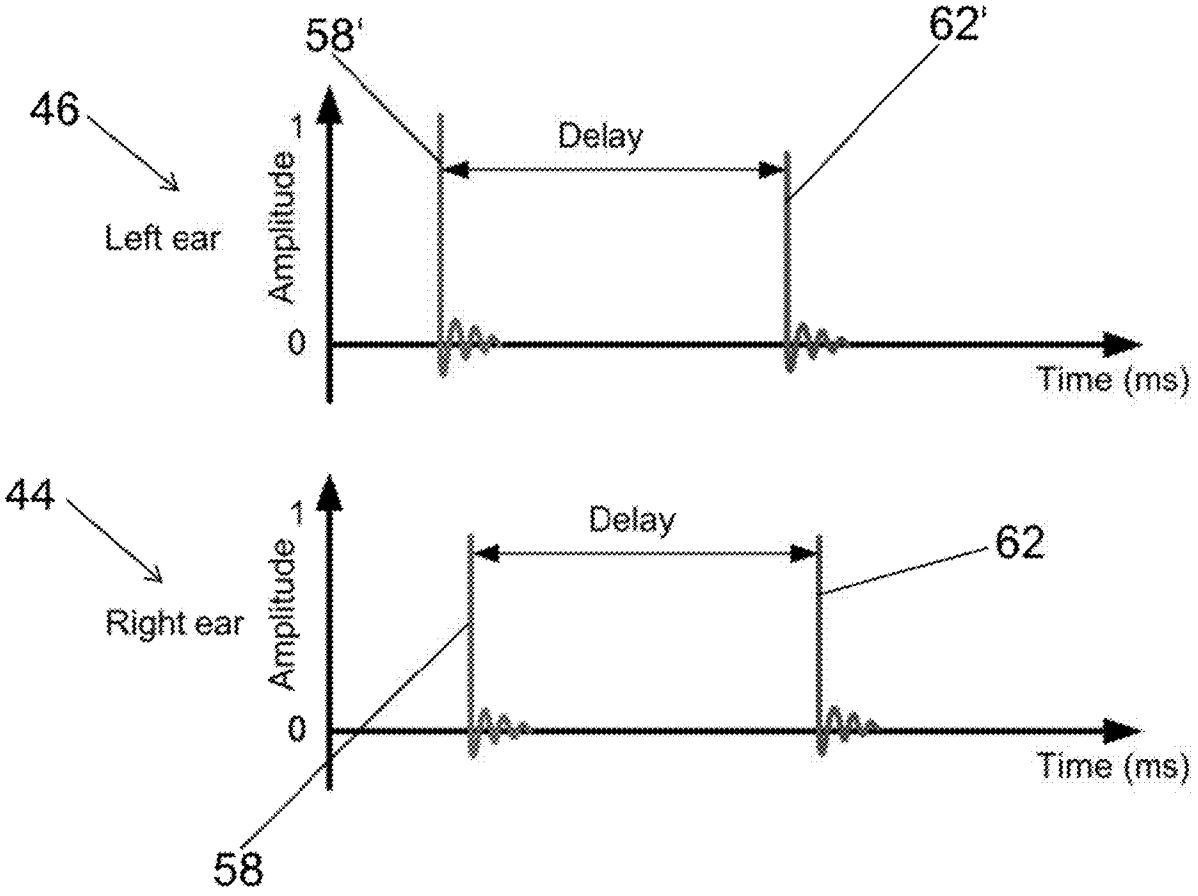
Figure 11:
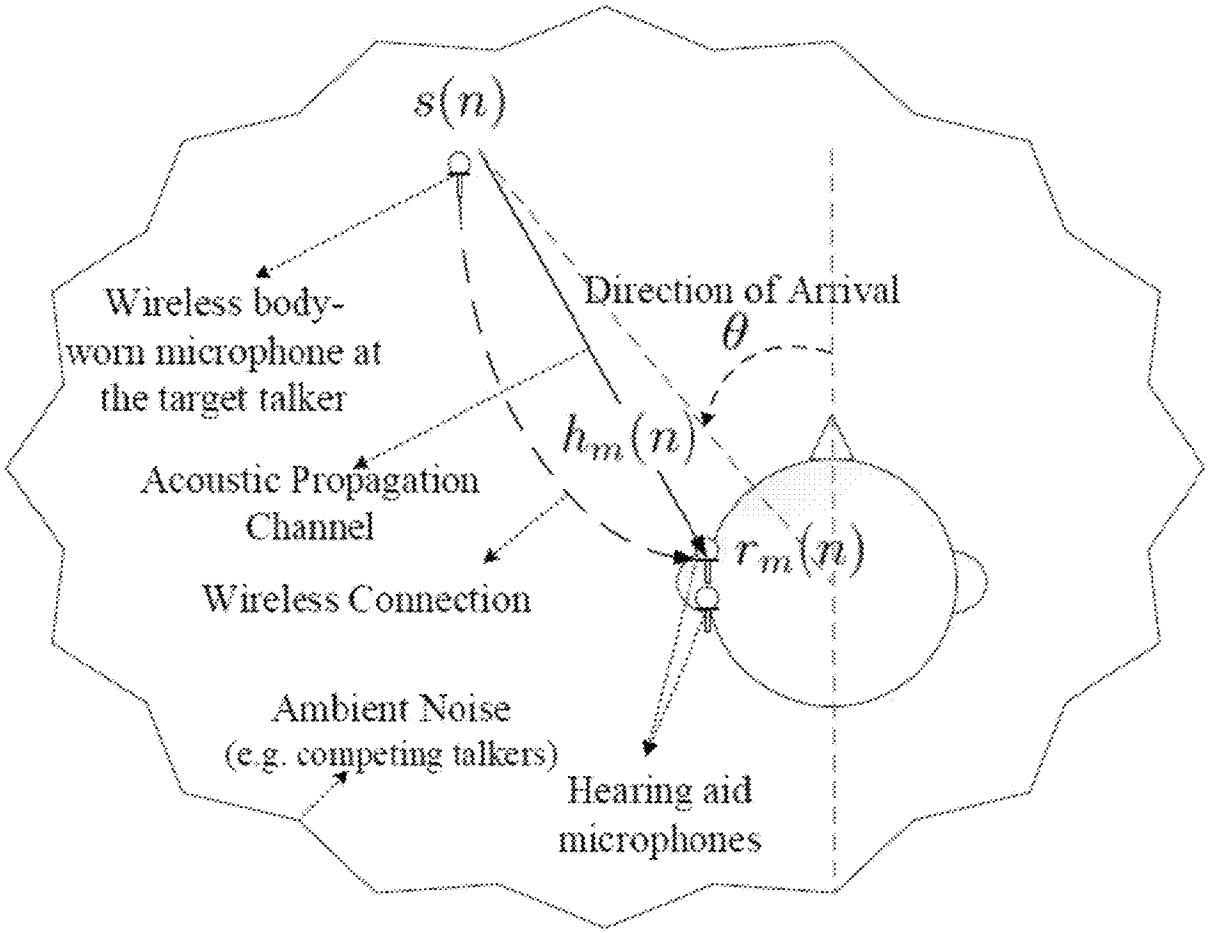

FIG. 3 schematically illustrates a hearing system with one user wearing a remote unit and another user wearing two hearing aids;

FIG. 4 schematically illustrates a hearing system with one hearing aid and one remote unit and performing an informed enhancement algorithm;

FIG. 5 schematically illustrates a hearing system with two binaurally used hearing aids and one remote unit and performing an informed localization algorithm;

FIG. 6 schematically illustrates a hearing system with a hearing aid and a remote unit and performing an informed localization algorithm using predetermined impulse responses;

FIG. 7 schematically illustrates a hearing system with a hearing aid and a remote unit and performing an informed localization algorithm using predetermined impulse responses;

FIG. 8 schematically illustrates alignment of an aux channel with a front microphone signal, by finding the maximum in the cross correlation and compensating for an offset by introducing a time delay;

FIG. 9 schematically illustrates a left and a right hearing aid microphone signal when taking the cross correlation between the left or right microphone and the remote microphone signal;

FIG. 10 schematically illustrates a left and a right hearing aid microphone signal after correcting a time delay;

FIG. 11 illustrates a situation where the noisy received sound signal at microphone m is a result of the convolution of the target signal with the acoustic channel impulse response from the target talker to microphone m, and is contaminated by additive noise.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in an In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Figure 1:
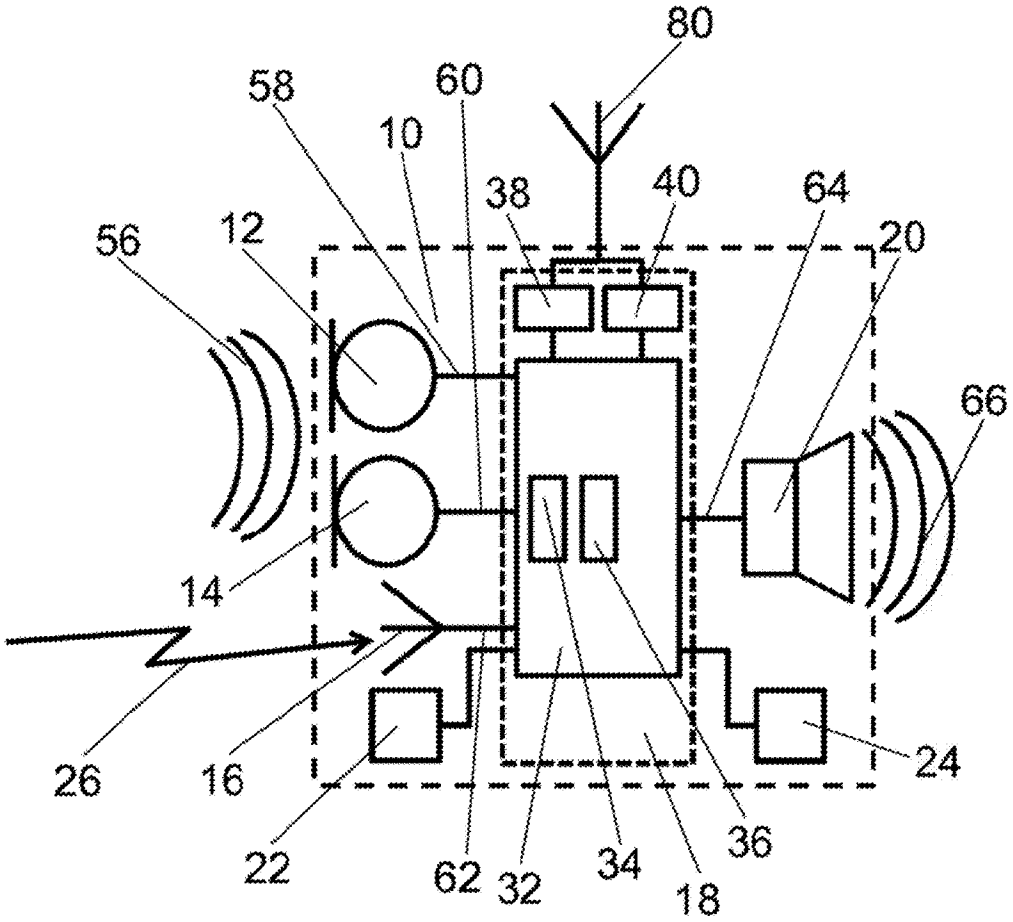
FIG. 1 is a schematic illustration of a hearing aid.

FIG. 1 schematically illustrates a hearing aid 10 with a first microphone 12, a second microphone 14, a first antenna 16, electric circuitry 18, a speaker 20, a user interface 22 and a battery 24. The hearing aid 10 can also comprise more than two microphones, such as an array of microphones, three, four or more than four microphones. The first antenna 16 may be a Bluetooth-Receiver, Infrared-Receiver, or any other wireless sound receiver configured to receive wireless sound signals 26, i.e., receiving electrical sound signals wirelessly. The speaker 20 may also for example be a bone vibrator of a bone-anchored hearing aid, an array of electrodes of a cochlear implant, or a combination of the aforementioned output sound transducers (not shown). The hearing aid 10 is part of a hearing system 28 (see FIG. 3) that comprises the hearing aid 10, a second hearing aid 10' and a remote unit 30. The hearing system 28 can also comprise more than two hearing aids and more remote units (not illustrated).

The electric circuitry 18 comprises a control unit 32, a processing unit 34, a memory 36, a receiver 38, and a transmitter 40. The processing unit 34 and the memory 36 are here a part of the control unit 32.

Figure 2:
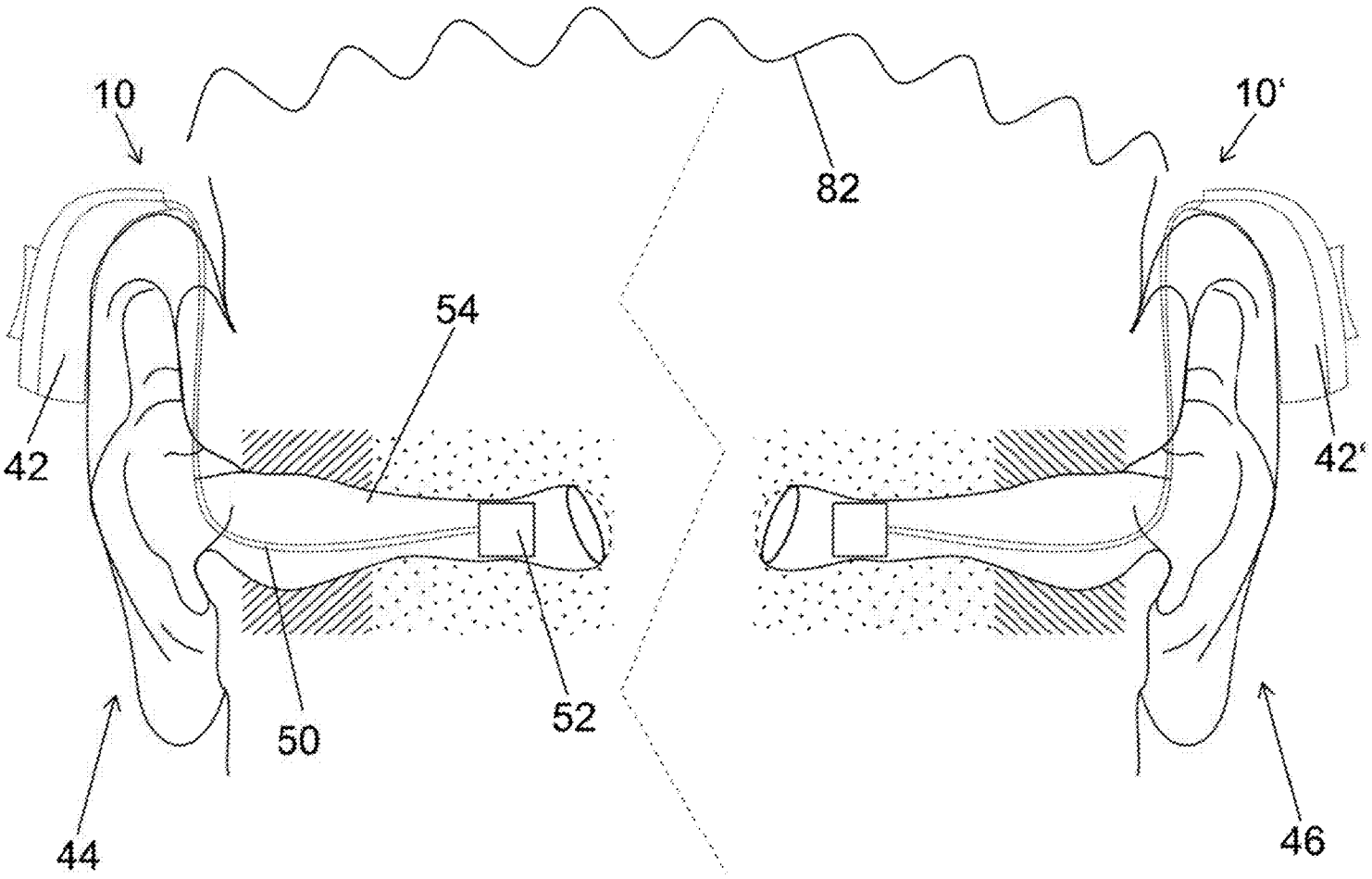
FIG. 2 is a schematic illustration of two binaurally used hearing aids mounted at two ears.

The components of hearing aid 10 are arranged in a housing. It may be advantageous to have two housing parts, where a major housing is configured to be fitted at or behind the pinna, and a minor housing is configured to be placed in or at the ear canal. The hearing aid 10 presented in FIG. 2 is of Receiver-In-The-Ear (RITE) style and has a Behind-The-Ear (BTE) unit 42 or 42' configured to be worn at or behind an ear 44 or 46 of a user 48 (see FIG. 2 and FIG. 3). The hearing aid 10 can for example be arranged in and at the right ear 44 and a second hearing aid 10' can be arranged in and at the left ear 46 of a user 48. A connector 50 connects the BTE-unit 42 with an insertion part 52 of the hearing aid 10, which is being arranged in an ear canal 54 of the user 48. The insertion part 52 in the configuration shown in FIG. 2 is arranged in the bony portion (dotted region) of the ear canal 54, but can also be arranged in the cartilaginous portion (shaded region). The housing of the hearing aid 10 can also be configured to be completely worn in the ear canal 54 or can also be of BTE, ITE, CIC, or any other hearing aid style (not illustrated here).

In FIG. 2, the BTE-unit 42 comprises the first 12 and second microphone 14, the first antenna 16, the electric circuitry 18, the user interface 22 and the battery 24. The insertion part 52 comprises speaker 20. Alternatively, the insertion part can also comprise one or both microphones 12, 14 and/or the first antenna 16. Signals between BTE-unit 42 and insertion part 52 can be exchanged via the connector 50.

The hearing aid 10 can be operated in various modes of operation, which are executed by the control unit 32 and use various components of the hearing aid 10. The control unit 32 is therefore configured to execute algorithms, to apply outputs on electrical sound signals processed by the control unit 32, and to perform calculations, e.g., for filtering, for amplification, for signal processing, or for other functions performed by the control unit 32 or its components. The calculations performed by the control unit 32 are performed using the processing unit 34. Executing the modes of operation includes the interaction of various components of the hearing aid 10, which are controlled by algorithms executed on the control unit 32.

In one hearing aid mode, the hearing aid 10 is used as a hearing aid for hearing improvement by sound amplification and filtering. In an informed enhancement mode, the hearing aid 10 is used to determine noisy components in a signal and attenuate the noisy components in the signal (see FIG. 4). In an informed localization mode, the hearing aid 10 is used to determine one or more sound source locations in a first step and to improve a signal by using the one or more sound source locations in a second step (see FIGS. 5 to 7).

The mode of operation of the hearing aid 10 can be manually selected by the user via the user interface 22 or automatically selected by the control unit 32, e.g., by receiving transmissions from an external device, obtaining an audiogram, receiving acoustical sound signals 56, receiving wireless sound signals 26 or other indications that allow to determine that the user 48 is in need of a specific mode of operation.

The hearing aid 10 operating in one hearing aid mode receives acoustical sound signals 56 with the first microphone 12 and second microphone 14 and wireless sound signals 26 with the first antenna 16. The first microphone 12 generates first electrical sound signals 58, the second microphone 14 generates second electrical sound signals 60 and the first antenna 16 generates noiseless electrical sound signals 62, which are provided to the control unit 32. If all three electrical sound signals 58, 60, and 62 are present in the control unit 32 at the same time, the control unit 32 can decide to process one, two, or all three of the electrical sound signals 58, 60, and 62, e.g., as a linear combination. The processing unit 34 of the control unit 32 processes the electrical sound signals 58, 60, and 62, e.g. by spectral filtering, frequency dependent amplifying, filtering, or other types of processing of electrical sound signals in a hearing aid generating electrical output sound signals 64. The processing of the electrical sound signals 58, 60, and 62 by the processing unit 32 depends on various parameters, e.g., sound environment, sound source location, signal-to-noise ratio of incoming sound, mode of operation, type of output sound transducer, battery level, and/or other user specific parameters and/or environment specific parameters. The electrical output sound signals 64 are provided to the speaker 20, which generates acoustical output sound signals 66 corresponding to the electrical output sound signals 64, which stimulates the hearing of the user 48. The acoustical output sound signals 66 thus correspond to stimuli which are perceivable as sound by the user 48.

The hearing aid 10 operating in an informed enhancement mode receives acoustical sound signals 56 with the first microphone 12 and second microphone 14 and wireless sound signals 26 with the first antenna 16 (see FIG. 4). The wireless sound signals 26 in FIG. 4 are generated by remote unit 30 which comprises a microphone 68 for receiving virtually noiseless acoustical sound signals 70 generated by a second user 72 (see FIG. 3) and for generating electrical sound signals from the received acoustical sound signals 70 and an antenna 74 for transmitting the electrical sound signals as wireless sound signals 26. The first microphone 12 generates first electrical sound signals 58, the second microphone 14 generates second electrical sound signals 60 and the first antenna 16 generates noiseless electrical sound signals 62, which are provided to the processing unit 34. The first 58 and second electrical sound signals 60 comprise environment sound information. The noiseless electrical sound signals 62 comprise noiseless sound information. The processing unit 34 uses the noiseless electrical sound signals 62 in a time-frequency processing framework by identifying time-frequency regions in the first 58 and second electrical sound signal 60 which are dominated by the noiseless electrical sound signals 62 and regions which are dominated by noise and/or reverberation. The processing unit 34 then attenuates the time-frequency regions in the first 58 and second electrical sound signals 60, which are dominated by noise and generates electrical output sound signals 64 based on the first 58 and second electrical sound signals 60 with attenuated time-frequency regions. Thus the electrical output sound signals 64 comprise the environment sound information of the first 58 and second electrical sound signals 60 and have an improved single-to-noise ratio, i.e., the electrical output sound signals 64 are noise reduced, as noise was attenuated with the help of the noiseless sound information. The electrical output sound signals 64 are then provided to the speaker 20 which can generate acoustical output sound signals 66 in order to stimulate hearing of user 48.

The hearing aid 10 operating in an informed localization mode receives acoustical sound signals 56 with the first microphone 12 and second microphone 14 and wireless sound signals 26 with the first antenna 16 (see FIGS. 6 and 7). The wireless sound signals 26 in FIG. 6 and FIG. 7 are generated by remote unit 30 which comprises a microphone 68 for receiving virtually noiseless acoustical sound signals 70 generated by a second user 72 (see FIG. 3) and for generating electrical sound signals from the received acoustical sound signals 70 and an antenna 74 for transmitting the electrical sound signals as wireless sound signals 26. The remote unit 30 can also comprise more than one microphone (not shown) which allows to improve the signal quality and ensures that only the target speaker is recorded. The remote unit 30 may also comprise a voice activity detector which is configured to detect when the voice of the target speaker, i.e., the second user 72 is active (not shown).

The voice activity detector allows to avoid that directions of other sounds are detected while the target speaker is not active. The first microphone 12 generates first electrical sound signals 58, the second microphone 14 generates second electrical sound signals 60 and the first antenna 16 generates noiseless electrical sound signals 62, which are provided to the processing unit 34. The first 58 and second electrical sound signals 60 comprise environment sound information. The noiseless electrical sound signals 62 comprise noiseless sound information.

Identifying position of, or just direction to, an active source may be accomplished in several ways. When a sound from a particular location (direction, and distance) reaches the microphones of a hearing system—which could be a single hearing device, or two wirelessly connected hearing devices, each having one or more microphones—the sound is filtered by the head/torso of the hearing device user, for now ignoring the filtering of the sound by reflecting surfaces in the surroundings, i.e., walls, furniture, etc. The filtering by the head/torso can be described by impulse responses (or transfer functions) from the position of the target sound source to the microphones of the hearing device. In practice, the signal received by the microphones in hearing device may be composed of one or more target signal sources and, in addition, some interference/noise components. Generally, the i'th microphone signal can be written as $$x_i(n)=\tilde{s}_i(n)+w_i(n), i=1,K,M,$$

where M denotes the number of microphones, $\tilde{s}_i(n)$ is the target signal (which could generally be a summation of several target signals), and $w_i(n)$ is the total noise signal (which could also be a summation of several noise sources), respectively, which are observed at the i'th microphone. Limiting us, only for ease of explanation, to the situation where there is only one target signal, the target signal measured at the i'th microphone is given by $$\tilde{s}_i(n)=s(n)*d_i(n),$$

where s(n) is the target signal measured at the target position, and d(n) is the impulse response from the target position to the i'th microphone.

Still on a completely general level, the problem may be solved using a priori knowledge available about the impulse responses $d_i(n)$ due to the fact that microphones are located at specific, roughly known, positions on a human head. More specifically, since the hearing aid microphones are located on/in/at the ear(s) of the hearing device user, the sound filtering of the head/torso imposes certain characteristics on each individual $d_i(n)$, and on which $d_i(n)$'s can occur simultaneously. For example, for an M=2 microphone behind-the-ear hearing device positioned on the right ear, and for a sound originating from the front of the wearer at a distance of 1.2 m, the impulse responses to each of the microphones would be shifted compared to each other because of the slightly longer travelling time from the target to the rear microphone, there would also be other subtle differences. So, this particular pair (M=2) of impulse responses represent sound impinging from this particular location. Supposing that impulse response pairs of all possible positions are represented in the hearing device, this prior knowledge may e.g. be represented by a finite, albeit potentially large, number of impulse response pairs, here "pairs" because M=2, or in some parametric representation, e.g., using a head model. In any case, this prior knowledge could be collected in an offline process, conducted in a sound studio with a head-and-torso simulator (HATS) at the hearing device manufacturer.

Remaining on a completely general level, at a given moment in time, the position or direction to the source may be identified by choosing from the set of all physically possible impulse response pairs the pair which, in some sense, best "explains" the observed microphone signal $x_i(n)$, i=1,K M. Since knowing for each impulse response pair in the collection, which position in space the response represents, the selected impulse response pair leads to a location estimate at this particular moment in time. The term "in some sense" is used to remain general; there are several possible "senses", e.g., least-mean square sense, maximum likelihood sense, maximum a posteriori probability sense, etc.

One way of estimating the position and/or direction is to select the most reasonable set of impulse responses $d_i(n)$, i=1,K M. It is clear that this idea can be generalized to that of selecting the sequence of impulse responses $d_i(n)$,i=1,K M,n=0,1,K which best explains the observed signal. In this generalized setting, the best sequence of impulse response sets is now selected from the set of all possible impulse response sequences, one advantages of operating with sequences is that it allows taking into account that the relative location/direction of/to sound sources typically show some consistency across time.

So, completely generally, the idea is to use prior knowledge on physically possible impulse responses from any spatial position to the hearing aid microphones, to locate sound sources.

The processing unit 34 uses the first 58 and the second electrical sound signals 60 in order to determine a directivity pattern or sound source location 76 (see 34*a* in FIG. 7). If there is more than one sound source present, the processing unit 34 can also be configured to determine more than one sound source location 76. In order to determine the sound source location 76 the memory 36 of the hearing aid 10 comprises predetermined impulse responses 78, e.g., head-related transfer functions (HRTFs) for a predetermined number of locations in space relative to the first 12 and second microphone 14. The memory can also comprise relative impulse responses, i.e., relative head-related transfer functions relative between the first 12 and second microphone 14 (not shown) thus that the relative difference between first 12 and second microphone 14 can be estimated using the relative impulse responses. Alternatively, an external unit may be used for storing and/or processing, such as a mobile phone, such as a smart-phone, a dedicated processing device or the like to leverage power consumption and/or processing power of the ear-worn device.

Thus, there are two predetermined impulse responses 78 for each location, one resulting for the first microphone 12 and one resulting for the second microphone 14. The processing unit 34 convolves the noiseless electrical sound signals 62 and the predetermined impulse responses 78 for each location in order to generate processed electrical sound signals. The processed electrical sound signals correspond to acoustical sound signals, which would be received by the microphones 12 and 14 when the sound source was located at the location corresponding to the predetermined impulse responses 78. The processing unit can also be configured to assign a valid or invalid sound source location flag to each respective time-frequency unit (not shown). Therefore a built-in threshold may determine if the respective time-frequency unit has a valid sound source location 76 or if the time-frequency unit is contaminated by noise and thus not suitable to base the determination of the sound source location 76 on the respective time-frequency unit.

The processing unit 34 generates processed electrical sound signals for all locations and compares the processed electrical sound signals to the first 58 and second electrical sound signals 60. The processing unit 34 then estimates the sound source location 76 as the location that corresponds to the location for which the processed electrical sound signals show the best agreement with the first 58 and second electrical sound signals 60 (see 34*a* in FIG. 7). The processing unit 34 can also comprise time-frequency level threshold values in order to allow for estimating one or more sound source locations 76. In this case, all locations that lead to a level difference in a predetermined time-frequency region for the processed electrical sound signals to the first 58 and second electrical sound signals 60 below a time-frequency level threshold value are identified as sound source locations 76. The processing unit 34 then generates electrical output sound signals 64 by convolving the predetermined impulse response 78 corresponding to the estimated sound source location 76 with the noiseless electrical sound signals 62. The memory 36 can also comprise predetermined impulse responses 78' that correspond to a transfer function from the sound source location to an ear drum of the user 48; said predetermined impulse responses 78' can also be convolved with the noiseless electrical sound signals 62 in order to generate the electrical output sound signals 64 (see 34*b* in FIG. 7). Additional processing of the noiseless electrical sound signals 62 in the processing unit 34 is possible before it is convolved. The electrical output sound signals 64 are provided to the speaker 20 which generates acoustical output sound signals 66.

The above may be implemented in many different ways. Specifically, it may be implemented in the time domain, the frequency domain, the time-frequency domain, the modulation domain, etc. In the following is described a particular implementation in the time-frequency domain via a short-time Fourier transform, for simplicity only one target source is present at the time, but this is only to make the description simpler; the method may be generalized to multiple simultaneous target sound sources.

Signal Model in the Short-time Fourier Transform Domain

In the short-time Fourier transform (stft) domain, the received microphone signals may be written as $$x(k, m)=s(k,m)d(k)+w(k,m),$$

where k=0,K K−1 is a frequency bin index, m is a frame (time) index, $x(k,m)=[x_1(k,m) \ldots x_M(k,m)]$ is a vector consisting of the stft coefficients of the observed signal for microphones i=1,K,M, s(k,m) is the stft coefficient of the target source (measured at the target position), $d(k)=[d_1(k) \ldots d_M(k)]$ are the discrete Fourier coefficients of the impulse response (i.e. transfer function) from the actual target location to microphones i=1,K,M (for ease of explanation only, it is assumed that the active impulse response is time-invariant), and $w(k,m)=[w_1(k,m) \ldots w_M(k,m)]$ is the vector of sift coefficients of the noise as measured at each microphone. So far, considered impulse responses have been considered from the target location to each microphone; however, it is equally possible to consider relative impulse responses, e.g., from the position of a given reference microphone to each of the other microphones; in this case, the vector $d(k)=[d_1(k) \ldots d_M(k)]$ represents the transfer function from a given reference microphone to each of the remaining microphones. As before, only a single additive noise term w(k,m) is included but this term could be a sum of several other noise terms (e.g., additive noise components, late-reverberation components, microphone noise components, etc.).

Assuming that target and noise signals are uncorrelated, the inter-microphone correlation matrix $R_{xx}(k,m)$ for the observed microphone signal may then be written as $$R_{xx}(k,m)=R_{ss}(k,m)+R_{ww}(k,m),$$

which may be expanded as $$R_{xx}(k,m)=\lambda_s(k,m)d(k)d^H(k)+\lambda_w(k,m)\Gamma_{ww}(k,m),$$

where $\lambda_s(k,m)$ is the power spectral density (psd) of the target speech signal at frequency k and in time frame m, $\lambda_w(k,m)$ is the psd of the noise, and $\Gamma_{ww}(k,m)$ is the inter-microphone noise coherence matrix. The problem at hand is now to find the vectors d(k),k=1.K K−1 which are best in agreement with the observed microphone signals.

Maximum—Likelihood Estimation

In the following is described a method which finds the vectors d(k) which explain the observed microphone signals the best in maximum-likelihood sense, and which uses a pre-collected dictionary of impulse responses from all possible spatial locations to the hearing aid microphones. Practically, this dictionary of impulse responses could be measured in a low-reverberation sound studio using e.g., a head-and-torso-simulator (HATS) with the hearing-aid(s) in question mounted, and sounds played back from the spatial locations of interest. Let $D(k)=[d^1(k),d^2(k),K,d^J(k)]$ denote the resulting dictionary of J sets of acoustic transfer functions, sampled at frequency index k. The dictionary could also be formed from impulse responses measured on different persons, with different hearing aid styles, or it could be the result of merging/clustering a large set of impulse responses.

Assume that s(k,m) and w(k,m) are zero-mean circular-symmetric Gaussian distributed, and uncorrelated with each other, then the noisy observable signal $$x(k,m)=s(k,m)d(k)+w(k,m)$$

is also Gaussian distributed, with covariance matrix given by (as above)

$$R_{xx}(k,m)=\lambda_s(k,m)d(k)d^H(k)+\lambda_w(k,m)\Gamma_{ww}(k,m).$$

The likelihood function can then be written as $$f(x(k,m);\lambda_s(k,m),\lambda_w(k,m),d(k))=\frac{1}{\pi^M|R_{xx}(k,m)|}\exp(-x^H(k,m)R_{xx}^{-1}(k,m)x(k,m)),$$

where $|\cdot|$ denotes the matrix determinant. It is assumed that the noise inter-microphone coherence matrix $\Gamma_{ww}(k,m)$ is known. In practice, it can be estimated in noise-only regions of the noisy signal x(k,m), which may be determined using a voice-activity detection (VAD) algorithm. So, the unknown parameters are the power-spectral densities of the target and noise signal, $\lambda_s(k,m)$, and $\lambda_w(k,m)$, respectively, and the vector of transfer functions d(k) from the target source to each microphone.

The log-likelihood function is then given by $$L(x(k,m);\lambda_s(k,m),\lambda_w(k,m),d(k))=\log(f(x(k,m);\lambda_s(k,m),\lambda_w(k,m),d(k)))$$

To find the maximum likelihood estimate of d(k) i.e., select the element of the dictionary element $d^j(k)$ leading to the highest likelihood, the likelihood of each and every dictionary element is calculated, $$L(d^j(k))=L(x(k,m);\lambda_s^{ML,j}(k,m),\lambda_w^{ML,j}(k,m),d^j(k)),j=1,K\ J,$$

where $\lambda_S^{ML,j}(k,m)$, and $\lambda_x^{ML,j}(k,m)$ are maximum likelihood estimates of $\lambda_s(k,m)$, and $\lambda_w(k,m)$ for $d(k)=d^j(k)$).

Finally, the dictionary element $d^{ML}(k)$ leading to highest likelihood is selected, $$d^{ML}(k)=\underset{d^j(k)\in D(k)}{\operatorname{argmax}}\,L(d^j(k)).$$

Maximum-Likelihood Estimation—Averaging Across Time and/or Frequency

The likelihood function above is described in terms of a single observation x(k,m). Under stationary conditions, estimation accuracy may be improved by considering the log-likelihood function of several successive observations, i.e., $$L_t(x(k,m');\lambda_s(k,m'),\lambda_w(k,m'),d(k))=\sum_{m=m'-M_1}^{m'+M_2}L(x(k,m);\lambda_s(k,m),\lambda_w(k,m),d(k)).$$

Similarly, if it is known that one target talker dominates all frequencies in a particular frame, it is advantageous to combine the log-likelihood function across frequency indices, $$L_f(x(k',m);\lambda_s(k',m),\lambda_w(k',m),d(k'))=\sum_{k=k'-L_1}^{k'+L_2}L(x(k,m);\lambda_s(k,m),\lambda_w(k,m),d(k)).$$

It is also possible to combine these equations to average across an entire time-frequency regions (i.e., to average across time and frequency rather than just across frequency or across time).

In all situations, the procedure described above may be adopted to find the maximum likelihood estimates of d(k) (and subsequently, the estimated target position).

Many other possibilities exist for combining local (in time-frequency) sound source location estimates. For example, histograms of local sound source location estimates may be formed, which better reveals the location of the target(s).

Uninformed and Informed Situations

The proposed framework is general and applicable in many situations. Two general situations appear interesting. In one situation, the target source location is estimated based on the two or more microphones of the hearing aid system (this is the situation described above)—this situation is referred to as un-informed.

Another, practically relevant, situation arises when an additional microphone is located at a known target talker. This situation arises, for example, with a partner microphone, e.g. the remote unit described herein, which comprises a microphone clipped onto a target talker, such as the spouse of the hearing device user, a lecturer, or the like. The partner microphone transmits wirelessly the target talker's voice signal to the hearing device. It is of interest to estimate the position of the target talker/partner microphone relative to the hearing device, e.g., for spatially realistic binaural sound synthesis. This situation is referred to as informed, because the estimation algorithm is informed of the target speech signal observed at the target position. The situation may also apply for e.g. a transmitted FM signal, e.g. via Bluetooth, or a signal obtained by a telecoil.

With the current framework, this may be achieved as $\lambda_s(k,m)$—the power-spectral density of the target talker—may be obtained directly from the wirelessly received target talker signal. This situation is thus a special case of the situation described above, where $\lambda_s(k,m)$ is known and does not need to be estimated. The expression for the maximum-likelihood estimate of $\lambda_w(k,m)$ when $\lambda_s(k,m)$ is known changes slightly compared to the un-informed situation described above.

As above, the informed problem described here can easily be generalized to the situation where more than one partner microphone is present.

Target Source Tracking

The present framework has been concerned with estimating sound source positions without any a priori knowledge about their whereabouts. Specifically, an estimate of a vector d(k) of transfer functions, and the corresponding sound source location, is found for a particular noisy time-frequency observation x(k,m), independently of estimates of previous time frames. However, physical sound sources are characterized by the fact that they change their position relative to the microphones of the hearing device or hearing devices with limited speed, although position changes may be rapid, e.g., for head movements of the hearing aid user. In any case, the above may be extended to take into account this apriori knowledge of the physical movement pattern of sound sources. Quite some algorithms for sound source tracking exist, which make use of previous source location estimates, and sometimes their uncertainty, to find a sound source location estimate at the present time instant. In the case of sound source tracking, other, or additional, sensors may be used, such as a visual interface (camera or a radar) or a built-in head tracker (based on e.g. an accelerometer or a gyro).

It is expected that the performance of the informed localization mode may degrade in reverberant situations, where strong reflections make the identification of the sound source location 76 difficult. In this situation, the informed localization mode can be applied to signal regions representing sound onset, e.g., speech onset, which is easy to identify in the noiseless electrical sound signals 62. Speech onsets have the desirable property, that they are less contaminated by reverberation. Also, the onsets impinge from the desired direction, where reflected sound may impinge from other directions.

The hearing aids 10 operating in informed localization mode presented in FIG. 6 and FIG. 7 are almost identical. The only difference is that the hearing aid 10 in FIG. 6 estimates the sound source location 76 only when a sound onset, e.g., a speech onset is detected in the processing unit 34. Therefore the processing unit 34 monitors the noiseless electrical sound signals 62 and determines whenever a sound onset is present in the noiseless electrical sound signals 62 by comparing the level and/or the level difference between two consecutive points of time of the noiseless electrical sound signals 62. If the level is low and the level difference is high a sound onset is detected and the sound source location 76 is determined. FIG. 6 does not show all components of the hearing aid 10 in detail but only the most relevant parts.

Furthermore, the hearing system 28 can be operated with two hearing aids 10 and 10' both operating in an informed localization mode (see FIG. 5). FIG. 5 does not show all components of the hearing aid 10 but only the components relevant to understand how the informed localization mode is meant to be performed on the hearing aids 10 and 10' of the hearing system 28. Hearing aid 10 receives acoustical sound signals 56 with the first microphone 12 and second microphone 14 and wireless sound signals 26 with the first antenna 16 and the hearing aid 10' receives acoustical sound signals 56' with the first microphone 12' and second microphone 14' and wireless sound signals 26' with the first antenna 16'. The first microphones 12 and 12' generate first electrical sound signals 58 and 58', the second microphones 14 and 14' generate second electrical sound signals 60 and 60' and the first antennae 16 and 16' generate noiseless electrical sound signals 62 and 62', which are provided to the processing unit 34 and 34'. The first 58, 58' and second electrical sound signals 60, 60' comprise environment sound information. The noiseless electrical sound signals 62, 62' comprise noiseless sound information. The processing unit 34 uses the first 58, 58' and the second electrical sound signals 60, 60' in order to determine a directivity pattern or sound source location. Therefore the electrical sound signals 58, 58', 60, 60', 62, and 62' can be transmitted between the two hearing aids 10 and 10'. Each of the hearing aids 10 and 10' comprises a second antenna 80 and 80', respectively, which allow to exchange data, such as electrical sound signals 58, 58', 60, 60', 62, 62', predetermined impulse responses 78, algorithms, operation mode instructions, software updates, predetermined electrical sound signals, predetermined time delays, audiograms, or other data via a wireless connection 82. The second antenna preferably establishes an inductive link between two hearing devices of a binaural hearing system. If there is more than one sound source present, the processing unit 34 can also be configured to determine more than one sound source location 76. In the informed case, the number of different sound locations could e.g. correspond to the number of transmitters sending "noiseless" sound signals to the hearing instruments. The memory 36 of each of the hearing aids 10 and 10' of the hearing system 28 has stored predetermined impulse responses 78 from many locations in space to each microphone 12, 12', 14, and 14' in the hearing system 28, e.g., in form of a three dimensional grid of locations (not shown). Thus, there are four predetermined impulse responses 78 for each location, one impulse response to each microphone. The aim is to determine the location of the sound source. The processing units 34 and 34, respectively, of the hearing system 28 do this by filtering, e.g., convolving the noiseless electrical sound signals 62, 62' through each of the predetermined impulse responses 78. The resulting four processed electrical sound signals correspond to acoustical sound signals that would be received, if the sound source was located at the location corresponding to the predetermined impulse response 78. The processing units 34 and 34', respectively, compare the four processed electrical sound signals synthesized in this way with the actually received first 58, 58' and second electrical sound signals 60, 60' for each and every possible location of the three dimensional grid. The processing units 34 and 34, respectively, of the hearing system 28 identify the location which generates processed electrical sound signals corresponding the best to the actually received first 58, 58' and second electrical sound signals 60, 60' as the sound source location 76. The mode is formulated in a statistical signal-processing framework, for example, the sound source location 76 is identified in maximum-likelihood sense. It is also possible to identify more than one sound source location 76, e.g., two, three or more than three, by for example using the location of the second best fit as the second sound source location and so on. After the sound source location 76 has been identified the sound source location 76 can be transmitted to the other hearing aid in order to check if both hearing aids 10 and 10' identified the same sound source location 76. If the sound source locations 76 do not agree, the sound source location 76 is chosen that was determined from the electrical sound signals with the higher signal to noise ratio. Alternatively all electrical sound signals may be available in both hearing aids 10 and 10' and may be used to determine the sound source location 76. The predetermined impulse response 78 of the sound source location 76 or a predetermined impulse response 78' corresponding to the transfer function from the sound source location 76 to the ear drum of the user 48 can be convolved with the noiseless electrical sound signals 62, 62' in order to generate electrical output sound signals 64 (not shown). The electrical output sound signals 64 can be provided to the speaker 20 of each of the hearing aids 10 and 10', which generates acoustical output sound signals 66 in order to stimulate the hearing of the user 48 (not shown).

Solving the informed localization problem, i.e., performing the informed localization mode is also valuable for determining sound source locations 76 in order to visualize an acoustic scene on a display for the user 48 and/or dispenser. The user 48 can then decide which or whether target sound sources at the estimated sound source locations 76 are of interest. Using the user interface 22 allows the user 48 to determine the target sound sources which should be amplified and other sound sources which should be attenuated by the hearing system 28.

The hearing aid 10 is powered by the battery 24 (see FIG. 1). The battery 24 has a low voltage between 1.35 V and 1.65 V. The voltage can also be in the range of 1 V to 5 V, such as between 1.2 V and 3 V. Other battery voltages may be used for e.g. bone-conduction hearing systems and/or cochlear implant systems. The capacity of the battery may also vary for various types of hearing systems.

The memory 36 is used to store data, e.g., predetermined impulse responses 78, algorithms, operation mode instructions, predetermined electrical output sound signals, predetermined time delays, audiograms, or other data, e.g., used for the processing of electrical sound signals.

The receiver 38 and transmitter 40 are connected to a second antenna 80. Antenna 80 allows the hearing aid 10 to connect to one or more external devices, e.g., allowing the hearing aid 10 of hearing system 28 to connect to the hearing aid 10' via wireless connection 82 (see FIG. 2 and FIG. 5), a mobile phone, an alarm, a personal computer or other devices. The antenna 80 allows the receiver 38 and transmitter 40 to receive and/or to transmit, i.e., exchange, data with the external devices. The hearing aid 10 of hearing system 28 can for example exchange algorithms, predetermined impulse responses 78, operation mode instructions, software updates, predetermined electrical sound signals, predetermined time delays, audiograms, or other data used, e.g., for operating the hearing aid 10. The receiver 38 and transmitter 40 can also be combined in a transceiver unit, e.g., a Bluetooth-transceiver, a wireless transceiver, or the like. The receiver 38 and transmitter 40 can also be connected with a connector for a wire, a connector for a cable or a connector for a similar line to connect an external device to the hearing aid 10.

FIG. 2 illustrates a binaural hearing system comprising the hearing aids 10 and 10' each with a Behind-The-Ear (BTE) unit 42 and 42'. One BTE-unit 42 is mounted behind the right ear 44 and one BTE-unit 42' is mounted behind the left ear 46 of the user 48. Each of the BTE units 42, 42' comprises the microphones 12 and 14 and the wireless receiver 16, the electric circuitry 18, the user interface 22, and the battery 24 (not shown). The speaker 20 (see FIG. 1) is arranged in the insertion part 52. The insertion part 52 is connected to the BTE-unit 42 via the lead 58. Hearing aid 10 and hearing aid 10' each comprise a receiver 38 and a transmitter 40. The combination of receiver 38 and transmitter 40 with second antenna 80 can be used to connect the hearing aid 10 with other devices, e.g., with the hearing aid 10' for binaural operation of the hearing aids 10 and 10'. If the hearing aids 10 and 10' are operated binaurally the two hearing aids 10 and 10' are connected with each other wirelessly. The transmitter 38 of the hearing aid 10 transmits data to the hearing aid 10' via the second antenna 80 and the receiver 40 of the hearing aid 10 receives data from the hearing aid 10' via antenna 80, and vice versa. The hearing aids 10 and 10' can exchange data, e.g., electrical sound signals 64 and 66, electrical output sound signals 68, predetermined impulse responses 78, sound source locations 76, data signals, audiograms, or other data, via the wireless connection 82.

FIG. 3 illustrates a hearing system 28 with two hearing aids 10 and 10' comprising BTE-units 42 and 42', respectively, worn by a user 48 and with remote unit 30 worn by a second user 72. The second user speaks which generates noiseless or virtually noiseless acoustical sound signals 70 which are received by the microphone 68 of the remote unit 30 and further generates acoustical sound signals 56 received by the first 12, 12' and second microphones 14, 14' of the hearing aids 10 and 10' of the user 48 (see also FIG. 5). The virtually noiseless acoustical sound signals 70 only have to travel a short distance between the mouth of the speaker and the microphone 68 in which they are received, therefore nearly no reverberation and/or noise are present in the acoustical sound signals 70. The acoustical sound signals 56 on the other hand have to travel a significant distance between the second user 72 and the microphones 12, 12', 14, and 14' of the hearing aids 10 and 10' worn by user 48, therefore significant noise and reverberation accumulates in the acoustical sound signals 56. The acoustical sound signals 70 are transformed into electrical sound signals and wirelessly transmitted as wireless sound signals 26 from the remote unit 30 using antenna 74 to the first antenna 16 and 16', respectively, of the hearing aids 10 and 10' (see also FIG. 5). Thus the user 48 receives in each of his hearing aids 10 and 10' nearly noiseless wireless sound signals 26 and acoustical sound signals 56 with spatial cues. The received signals can be used to generate nearly noiseless binaural sound signals, which can then be presented to the user 48.

FIG. 8 shows the alignment of noiseless electrical sound signals 62, i.e., auxiliary signals 62 with electrical sound signals 58, i.e., front microphone signals 58, by finding the maximum in the cross correlation and compensating for an off-set by introducing a time delay. The electrical sound signals 58 generated by first microphone 12, e.g., the front microphone and the noiseless electrical sound signals 62 received by antenna 16 are passed to processing unit 34. Processing unit 34 comprises a cross correlation unit 84 which determines the cross correlation between the electrical sound signals 58 and the noiseless electrical sound signals 62 in order to determine a time delay. The time delay can then be applied to the noiseless electrical sound signals 62 in the time delay unit 86 in order to temporally align the electrical sound signals 58 and the noiseless electrical sound signals 62. Further, the time delay provides a measure of the distance to the target source. Knowing the approximate distance to the target the compression of the sound could be changed, e.g. typically a compressed sound signal is perceived as being closer to a listener that a less compressed sound signal. Another, or additional, use of the distance estimate is application of artificial reverberation, e.g. artificial reverberation could be added to the received wireless signal, where the reflections depend on the estimated source distance, e.g. a short distance would yield reverberations with early reflections, and longer distances would yield later reflections. The time delay can also be applied to the electrical sound signals 58. This alignment can be necessary as the wireless sound signals 26 are transmitted with speed of light, while the acoustical sound signals 56 are transmitted with speed of sound only. Furthermore the wireless sound signals 26 have to be processed before they are transmitted and have to be processed after they are received which can take a longer time than the acoustic transmission with speed of sound. Thus a time delay is generated from the different travel times and processing times of the two types of signals. When the hearing aid 10 comprises a closed venting opening or no venting opening it may be desirable to align the noiseless electrical sound signals 62 with the electrical sound signals 58. If the venting opening, however, is open, it may be preferable to align the noiseless electrical sound signal 62 with the acoustical sound signals 56 passing through the venting opening and arriving at the eardrum of the user 48. This alignment is only possible, if the transmission of the noiseless electrical sound signal 62 is faster than the transmission of the acoustical sound signals 56, thus that a time delay can be applied to the noiseless electrical sound signals 62 in order to align them with the acoustical sound signals 56 at the eardrum of the user 48.

It is not an absolute requirement to align the microphone and the aux signals, i.e. so that they play at the same time, but one thing that seems to improve the performance is when the delay difference between the microphone signal and the aux signal is the same at the two ears. Thus, it does not matter whether the microphone signal or the aux signal comes first. This may be achieved by determining the cross correlation which is then used to estimate the delay difference, and this delay difference is then "corrected" such that the delay is the same as that of the other hearing aid. Aligning the microphone and the aux signals, as described above, would still be very beneficial.

It is also possible to improve the signal to noise ratio while preserving spatial cues without time-frequency processing, head-related transfer functions (HRTFs) or binaural communication. In the normal listening situation of the hearing system 28 with a user 48 wearing the two hearing aids 10 and 10' and a user 72 wearing the remote unit 30 with the remote unit microphone 68, i.e., remote microphone, both the electrical sound signals 58 and 58', i.e., hearing aid microphone signals and the noiseless electrical sound signals 62 and 62', i.e., remote auxiliary microphone (aux) signals are presented to the listener 48 at the same time. This allows the listener 48 to clearly hear the talker 72 wearing the remote microphone 68, while at the same time being aware of the surrounding sound. The electrical sound signals 58 (58') and the noiseless electrical sound signals 62 (62') typically do not arrive at the ear 44 (46) at the same time. The time delay difference is not necessarily the same at the two ears 44 and 46, because an interaural time difference (ITD) can be introduced in the electrical sound signals 58 and 58' when the listener 48, e.g., rotates his or her head. On the other hand the noiseless electrical sound signals 62 and 62' are identical at the two ears (leading to in-the-head-localization).

If the noiseless electrical sound signals 62 and 62' can be made to follow the interaural time delay (ITD) introduced by the electrical sound signals 58 and 58', the noiseless electrical sound signals 62 and 62' will also be perceived to be outside the head. This can be achieved by measuring, at each ear 44 and 46, the difference in time delay between the electrical sound signal 58, 58' and the noiseless electrical sound signal 62, 62', respectively. This can be done by finding the maximum in the cross correlation function between the two signals 58 and 62 (58' and 62'). A better result is obtainable when the cross correlation is determined for low frequencies, e.g., below 1.5 kHz. For higher frequencies the signal envelopes can be used to determine the cross correlation. The time delay can be used to align the noiseless electrical sound signal 62 (62') so that it follows the electrical sound signal 58 (58'). Thus, after correction, the time delay between the electrical sound signals 58, 58' and the noiseless electrical sound signals 62, 62' is the same at the two ears 44 and 46. If this is done the noiseless electrical sound signals 62, 62' will no longer be perceived to be in the head, but will follow the location of the talker 72 with the remote microphone 68. The appropriately delayed, essentially noise-free aux signal, i.e., noiseless electrical sound signal 62 (62') may be mixed with the generally noisy hearing aid microphone signal, i.e., electrical sound signal 58 (58') before playback in order to achieve a desired signal-to-noise ratio.

By employing the method described, no binaural communication is necessary. Binaural coordination can, however, be used if it is desired to give an estimate of the direction (angle) to the talker 72. This can be done by comparing the time delays estimated by the cross correlations at each ear. From the resulting interaural time delay (ITD) estimate an angle can be calculated. The advantage of using such a method for estimating the target direction is that full band audio signals do not have to be transmitted from one hearing aid to the other across the head. Instead only estimated time delay values need to be transmitted once in a while.

If two hearing aids 10 and 10' are used one on each of the two ears 44 and 46 the time delay generated between the electrical sound signals 58 and 58' to the respective noiseless electrical sound signals 62 and 62' received via wireless transmission can be different. This difference can, e.g., result from the relative position of the head of the user to the target sound source, thus that one ear can be closer to the target sound source than the other ear. In this case the spatial impression can be regained in the noiseless electrical sound signals 62 and 62', if the time delay between the electrical sound signals 58 and 58' is applied to the noiseless electrical sound signals 62 and 62'.

FIG. 9 shows an example of two electrical sound signals 58 and 58', respectively, generated at the right ear 44 and left ear 46 hearing aids 10 and 10' with the noiseless electrical sound signals 62 and 62'. The upper graph shows the situation at the left ear 46 and the lower one shows the situation at the right ear 44. In this situation the electrical sound signals 58 and 58' arrive at the processing unit 34 prior to the noiseless electrical sound signals 62 and 62'. The right electrical sound signal 58 arrives slightly after the left electrical sound signal 58' and has slightly smaller amplitude. The noiseless electrical sound signals 62 and 62' arrive at the same time with the same amplitude. Thus the time delays determined by the cross correlations are different.

FIG. 10 shows the two electrical sound signals 58 and 58' and the noiseless electrical sound signals 62 and 62'. The upper graph shows the situation at the left ear 46 and the lower one shows the situation at the right ear 44. The noiseless electrical sound signals 62 and 62' are different and follow the interaural time difference (ITD) of the electrical sound signals 58 and 58', respectively. In this way the noiseless electrical sound signals 62 and 62' are perceived as outside of the head when presented to the user 48.

FIG. 11 illustrates a situation where the noisy received sound signal rm(n) at microphone m is a result of the convolution of the target signal s(n) with the acoustic channel impulse response hm(n) from the target talker to microphone m, and is contaminated by additive noise vm(n). For each microphone of the hearing system, we can write:

$$rm(n)=dm(n)+vm(n);\ m=1;\ .\ .\ .\ ;M;$$

$$dm(n)=s(n)*hm(n);$$

where M≥1 is the number of available microphones, n is the discrete time index, and * is the convolution operator.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an interventing elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

REFERENCE SIGNS

10 hearing aid
12 first microphone
14 second microphone
16 first antenna
18 electric circuitry
20 speaker
22 user interface
24 battery
26 wireless sound signal
28 hearing system
30 remote unit
32 control unit
34 processing unit
36 memory
38 receiver
40 transmitter
42 Behind-The-Ear unit
44 right ear
46 left ear
48 user
50 connector
52 insertion part
54 ear canal
56 acoustical sound signal
58 first electrical sound signal
60 second electrical sound signal
62 third electrical sound signal
64 electrical output sound signal
66 acoustical output sound signal
68 remote unit microphone
70 virtually noiseless acoustical sound signal
72 second user
74 remote unit antenna
76 sound source location data
78 predetermined impulse response
80 second antenna
82 wireless connection
84 cross correlation unit
86 time delay unit

The invention claimed is:

1. A binaural hearing aid system comprising a first hearing aid device configured to be worn at, behind and/or in an ear of a user, and a second hearing aid device configured to be worn at, behind and/or in an ear of a user, wherein the first hearing aid device comprises:

a direction sensitive input sound transducer unit configured to convert acoustical sound signals into electrical noisy sound signals, a wireless sound receiver unit configured to receive wireless sound signals from a remote device, the wireless sound signals representing noiseless electrical sound signals, and a memory storing sets of head related impulse responses for different positions relative to the direction sensitive input transducer unit, wherein a processing unit is configured to estimate the direction to an active source, and the processing unit configured to map the electrical noisy sound signals and the wireless sound signals into binaural electrical output signals by convolving the noiseless electrical sound signals with the set of the head related impulse responses stored in the memory in correspondence with the estimated sound source location.

2. The binaural hearing aid system according to claim 1, wherein the processing unit is configured to estimate the direction to an active source by use of Maximum-Likelihood Estimation.

3. The binaural hearing aid system according to claim 1, wherein the sets of head related impulse responses stored in the memory correspond to a respective set of predetermined transfer functions, and wherein the processing unit is configured to determine a most likely sound source location relative to the hearing device based on processed electrical sound signals generated by applying each of the set of predetermined transfer functions to the noiseless electrical sound signals, and electrical sound signals from the direction sensitive input sound transducer.

4. The binaural hearing aid system according to claim 3, wherein the processing unit is configured to determine the most likely sound source location relative to the hearing device based on a statistical signal processing framework.

5. The binaural hearing aid system according to claim 3, wherein the wireless sound receiver unit is further configured to receive wireless sound signals from the second hearing device, the second hearing device comprising a direction sensitive input sound transducer, the processor is configured to determine the most likely sound source location relative to the binaural hearing system based further on electrical sound signals from the second hearing device's direction sensitive input sound transducer.

6. The binaural hearing aid system according to claim 1, wherein the processing unit is configured to determine a value of a level difference of the noiseless electrical sound signals between two consecutive points of time, and wherein the processing unit is configured to estimate the direction to the active source whenever the value of the level difference is above a predetermined threshold value of the level difference.

7. The binaural hearing aid system according to claim 1, wherein the processing unit is configured to determine a delay between the reception of the wireless sound signals and the corresponding electrical noisy sound signals, and apply the delay to the wireless sound signals.

8. The binaural hearing aid system according to claim 1, further comprising an output sound transducer configured to generate stimuli from electrical output sound signals, which are perceivable as sounds by the user.

9. The binaural hearing aid system according to claim 1, wherein the processing unit is configured to use the wireless sound signals in order to identify noisy time-frequency regions in the electrical noisy sound signals, and wherein the processing unit is configured to attenuate the noisy time-frequency regions of the electrical noisy sound signals when generating the binaural electrical output sound signals.

10. The hearing device according to claim 9, wherein the processing unit is configured to identify noisy time-frequency regions by subtracting the electrical noisy sound signals from the noiseless electrical sound signals and determining whether time-frequency regions of the resulting electrical sound signals are above a predetermined value of a noise detection threshold.

11. A hearing system comprising the first hearing aid device of the binaural hearing aid system according to claim 1, and the remote device according to claim 1, comprising an input sound transducer unit configured to receive acoustical sound signals and to generate the noiseless electrical sound signals, a transmitter configured to generate the wireless sound signals from the noiseless electrical sound signals and to transmit the wireless sound signals to the wireless sound receiver unit of the first hearing aid device.

12. A method for generating electrical output sound signals in a binaural hearing aid system comprising a first hearing aid device configured to be worn at, behind and/or in an ear of a user, and a second hearing aid device configured to be worn at, behind and/or in an ear of a user, the method comprising the steps:

receiving acoustical sound signals from a target source via a direction sensitive input sound transducer unit in the first hearing aid device, using the direction sensitive input sound transducer to generate electrical noisy sound signals from the received acoustical sound signals, receiving, via a wireless sound receiver unit in the first hearing aid device, wireless sound signals from a remote device representing noiseless electrical sound signals from the target source, storing, within a memory in the first hearing aid device, sets of head related impulse responses for different positions relative to the direction sensitive input transducer unit, wherein the binaural electrical output signals are generated by the processing unit estimating the direction to an active source, and mapping the electrical noisy sound signals and the wireless sound signals into the binaural electrical output signals by convolving the noiseless electrical sound signals with the set of the head related impulse responses stored in the memory in correspondence with the estimated sound source location.

13. The method according to claim 12, wherein the mapping of the electrical noisy sound signals and noiseless electrical sound signals by the processing unit comprises using the noiseless electrical sound signals to identify noisy time-frequency regions in the electrical noisy sound signals, and attenuating the noisy time-frequency regions of the electrical noisy sound signals in order to generate the binaural electrical output sound signals.

* * * * *